US011225802B2

(12) United States Patent
Charitou et al.

(10) Patent No.: US 11,225,802 B2
(45) Date of Patent: Jan. 18, 2022

(54) PROP HEAD ASSEMBLY

(71) Applicants: George Charitou, King (CA); Mubashir Choudhry, Oakville (CA)

(72) Inventors: George Charitou, King (CA); Mubashir Choudhry, Oakville (CA)

(73) Assignee: George Charitou, King (CA)

( * ) Notice: Subject to any disclaimer, the term of this patent is extended or adjusted under 35 U.S.C. 154(b) by 251 days.

(21) Appl. No.: 15/730,820

(22) Filed: Oct. 12, 2017

(65) Prior Publication Data

US 2019/0112824 A1 Apr. 18, 2019

(51) Int. Cl.

| | |
|---|---|
| ***E04G 11/50*** | (2006.01) |
| ***E04G 11/48*** | (2006.01) |
| ***E04G 11/38*** | (2006.01) |

(52) U.S. Cl.

CPC ..... *E04G 11/50* (2013.01); *E04G 11/38* (2013.01); *E04G 11/48* (2013.01); *E04G 11/483* (2013.01)

(58) Field of Classification Search

CPC ..... E04G 11/38; E04G 11/48; E04G 11/483; E04G 11/486; E04G 11/50

See application file for complete search history.

(56) References Cited

U.S. PATENT DOCUMENTS

| | | | |
|---|---|---|---|
| 4,558,968 | A | 12/1985 | Meickl |
| 5,062,733 | A | 11/1991 | Cholid et al. |
| 5,614,122 | A | 3/1997 | Schworer |
| 5,683,609 | A | 11/1997 | Schworer |
| 7,201,541 | B2 | 4/2007 | Barmann |
| 7,530,545 | B2 | 5/2009 | Gillespie et al. |

(Continued)

FOREIGN PATENT DOCUMENTS

| | | | |
|---|---|---|---|
| DE | 3004245 | A1 | 8/1981 |
| DE | 3316557 | | 10/1984 |

(Continued)

OTHER PUBLICATIONS

Translation of DE 4305302 A1, (Peri GmbH). (Year: 1994).*

(Continued)

*Primary Examiner* — Michael Safavi

(74) *Attorney, Agent, or Firm* — Carter, DeLuca & Farrell LLP; George Likourezos

(57) ABSTRACT

Apparatus is provided for vertically-extending construction column and horizontal construction beam assembly having beam-reference portion. Apparatus includes prop head assembly configured to be fixedly connected to vertically-extending construction column, and also configured to support horizontal construction beam assembly once the prop head assembly is fixedly connected to vertically-extending construction column. Prop head assembly includes first beam-locating feature and second beam-locating feature. First beam-locating feature configured to selectively receive, at least in part, the beam-reference portion. Second beam-locating feature configured to selectively receive, at least in part, the beam-reference portion. Second beam-locating feature is also configured to receive beam-reference portion once the beam-reference portion is inadvertently displaced away from first beam-locating feature and from vertically-extending construction column and toward second beam-locating feature.

3 Claims, 27 Drawing Sheets

(56) References Cited

U.S. PATENT DOCUMENTS

| | | | | |
|---|---|---|---|---|
| 7,571,888 | B2 | 8/2009 | Arozena Bergaretxe | |
| 7,640,871 | B2 | 1/2010 | Arozena Bergaretxe | |
| 7,971,395 | B1 | 7/2011 | Vigil et al. | |
| 8,051,626 | B2 | 11/2011 | Ubinana Felix | |
| 8,262,056 | B2 | 9/2012 | Schwoerer | |
| 10,053,875 | B1 * | 8/2018 | Baron | E04G 11/38 |
| 10,487,521 | B2 | 11/2019 | Baron et al. | |
| 2007/0200049 | A1 | 8/2007 | Coday | |
| 2019/0010716 | A1 * | 1/2019 | Baron | E04G 25/065 |
| 2019/0010717 | A1 * | 1/2019 | Baron | E04G 11/486 |
| 2019/0063086 | A1 | 2/2019 | Uribeetxebarria Zubia et al. | |
| 2019/0071885 | A1 * | 3/2019 | Faresin | E04G 11/483 |
| 2019/0078340 | A1 * | 3/2019 | Faresin | B28B 7/0032 |

FOREIGN PATENT DOCUMENTS

| | | | | |
|---|---|---|---|---|
| DE | 3921064 | A1 | 1/1991 | |
| DE | 4305302 | A1 * | 8/1994 | E04G 11/483 |
| DE | 4204773 | | 2/1996 | |
| DE | 19636091 | A1 | 3/1998 | |
| DE | 102010001042 | | 7/2011 | |
| DE | 102011082841 | | 10/2015 | |
| EP | 0380149 | A1 | 8/1990 | |
| EP | 1251222 | | 10/2002 | |
| EP | 1314835 | A1 | 5/2003 | |
| EP | 1617013 | | 1/2006 | |
| EP | 1617013 | A1 | 1/2006 | |
| EP | 2570568 | | 3/2013 | |
| EP | 02679744 | A1 | 1/2014 | |
| EP | 2749713 | A1 * | 7/2014 | E04G 11/486 |
| EP | 3112556 | A1 | 1/2017 | |
| EP | 3176349 | A1 | 6/2017 | |
| EP | 3202998 | A1 | 8/2017 | |
| FR | 2760482 | A1 | 9/1998 | |
| FR | 3021985 | B1 | 5/2018 | |
| GB | 1561377 | | 2/1980 | |
| GB | 2265654 | | 10/1993 | |
| GB | 2265655 | A | 10/1993 | |
| WO | 0169014 | A1 | 9/2001 | |
| WO | 02084050 | A1 | 10/2002 | |
| WO | 2006100694 | | 9/2006 | |
| WO | WO-2006100694 | A1 * | 9/2006 | E04G 11/486 |
| WO | 2011089148 | | 7/2011 | |
| WO | 2019156958 | A1 | 8/2019 | |
| WO | WO-2019202623 | A1 * | 10/2019 | E04G 17/005 |

OTHER PUBLICATIONS

Simon Webster, International Search Report for PCT/CA2018/050994, dated Nov. 7, 2018.

Simon Webster, Written Opinion of the ISA for PCT/CA2018/050994, dated Nov. 7, 2018.

Indian Office Action including English translation, dated Jan. 14, 2021, issued in corresponding Indian Application No. 202017008149, 6 pages.

Extended European Search Report dated Apr. 23, 2021, issued in corresponding European Appln. No. 18866931, 10 pages.

* cited by examiner

PROP HEAD ASSEMBLY

TECHNICAL FIELD

This document relates to (and is not limited to) the technical field of a prop head assembly, and/or a prop head assembly for a vertically-extending construction column and for a horizontal construction beam assembly, and/or a structure (such as a building, a bridge, etc.) having a prop head assembly, and/or a method associated with a prop head assembly), etc.

BACKGROUND

Shoring is a process of temporarily supporting a structure (such as a building, a vessel, a trench) with shores (also called props or supports) when there is a danger of collapse of the structure or during construction, repairs or alterations (of the structure). Shoring may be vertical, angled, or horizontal. A prop (also called a prop assembly) is an object (also called a support) placed beneath or against a structure to keep the structure from falling or shaking.

SUMMARY

It will be appreciated that there exists a need to mitigate (at least in part) at least one problem associated with the existing props (also called the existing technology). After much study of the known systems and methods with experimentation, an understanding (at least in part) of the problem and its solution has been identified (at least in part) and is articulated (at least in part) as follows:

A horizontal construction beam assembly is configured to be supported by a beam-locating feature of a prop head assembly. The prop head assembly is configured to be fixedly connected to a vertically-extending construction column. Once the horizontal construction beam assembly is received or supported by the first beam-locating feature of the prop head assembly, the horizontal construction beam assembly, in use, remains stationary relative to the vertically-extending construction column (and also remains stationary relative to the prop head assembly).

However, inadvertent (unwanted) lateral movement of the horizontal construction beam assembly (away from the first beam-locating feature and the vertically-extending construction column) leads to (causes) a dangerous condition in which the horizontal construction beam assembly may fall (drop) away from the prop head assembly to the working surface. It is a potentially dangerous case where the horizontal construction beam assembly becomes inadvertently or accidentally displaced from (moved away from) the first beam-locating feature of the prop head assembly, which may lead to unwanted injury to workers, damage to the construction site and/or delay in construction scheduling.

In view of the foregoing, to mitigate the above problem, what may be needed is an assembly configured to provide a fail-safe feature configured to reduce (at least in part) inadvertent displacement of a beam assembly once the beam assembly is placed in a relatively stationary position (in which the beam assembly may be utilized as part of a structure).

In view of the foregoing, to mitigate the above problem, what may be needed is a prop head assembly including (and is not limited to) a first beam-locating feature and a second beam-locating feature, in which the second beam-locating feature is configured to receive the beam-reference portion of the horizontal construction beam assembly once the horizontal construction beam assembly is inadvertently displaced (moved) away from the first beam-locating feature and toward the second beam-locating feature.

To mitigate, at least in part, at least one problem associated with the existing technology, there is provided (in accordance with a major aspect) an apparatus. The apparatus is provided for a column, and for a horizontal construction beam assembly having a beam-reference portion. The apparatus includes and is not limited to (comprises) a prop head assembly configured to be fixedly connected to the column. The prop head assembly is also configured to support, at least in part, the horizontal construction beam assembly once the prop head assembly is fixedly connected to the column. The prop head assembly includes (and is not limited to) a first beam-locating feature configured to selectively receive, at least in part, the beam-reference portion. The prop head assembly also includes (and is not limited to) a second beam-locating feature that is spaced apart from the first beam-locating feature, and the second beam-locating feature configured to selectively receive, at least in part, the beam-reference portion. The second beam-locating feature is configured to receive the beam-reference portion of the horizontal construction beam assembly once the beam-reference portion of the horizontal construction beam assembly is inadvertently displaced away from the first beam-locating feature and from the column and toward the second beam-locating feature.

To mitigate, at least in part, at least one problem associated with the existing technology, there is provided (in accordance with a major aspect) an apparatus. The apparatus is provided for a column, and for a horizontal construction beam assembly having a beam-reference portion. The apparatus includes and is not limited to (comprises) a prop head assembly configured to be fixedly connected to the column. The prop head assembly is also configured to support, at least in part, the horizontal construction beam assembly once the prop head assembly is fixedly connected to the column. The prop head assembly includes (and is not limited to) a first beam-locating feature configured to selectively receive the beam-reference portion of the horizontal construction beam assembly (this is done in such a way that the first beam-locating feature, in use, locates the beam-reference portion of the horizontal construction beam assembly at a first stationary position relative to the column once the first beam-locating feature, in use, selectively receives the beam-reference portion). The prop head assembly also includes (and is not limited to) a second beam-locating feature spaced apart from the first beam-locating feature. The second beam-locating feature is configured to selectively receive the beam-reference portion of the horizontal construction beam assembly (this is done in such a way that the second beam-locating feature, in use, locates the beam-reference portion of the horizontal construction beam assembly at a second stationary position relative to the column once the second beam-locating feature, in use, selectively receives the beam-reference portion). The second beam-locating feature is also configured to receive the beam-reference portion of the horizontal construction beam assembly once the beam-reference portion of the horizontal construction beam assembly is inadvertently displaced away from the first beam-locating feature and also displaced away from the column.

To mitigate, at least in part, at least one problem associated with the existing technology, there is provided (in accordance with a major aspect) a method. The method is for the operating a prop head assembly provided for a column, and for a horizontal construction beam assembly having a beam-reference portion. The method includes and is not limited to (comprises) fixedly connecting the prop head assembly to the column. The method also includes (and is not limited to) using the prop head assembly to support, at least in part, the horizontal construction beam assembly once the prop head assembly is fixedly connected to the column. The method also includes (and is not limited to) selectively receiving, at least in part, the beam-reference portion at a first beam-locating feature of the prop head assembly. The method also includes (and is not limited to) selectively receiving, at least in part, the beam-reference portion at a second beam-locating feature, in which the second beam-locating feature is spaced apart from the first beam-locating feature. The method also includes (and is not limited to) receiving the beam-reference portion at the second beam-locating feature once the beam-reference portion is inadvertently displaced away from the first beam-locating feature and from the column and toward the second beam-locating feature.

To mitigate, at least in part, at least one problem associated with the existing technology, there is provided (in accordance with a major aspect) an apparatus. The apparatus includes and is not limited to (comprises) a structure. The structure may include a home, a building, a vessel, a bridge, a trench, a man-made formation, etc., and any equivalent thereof. The structure includes (and is not limited to) a synergistic combination of assemblies, etc., such as a vertically-extending construction column configured to be positionable on a working surface (this is done in such a way that the vertically-extending construction column, in use, extends vertically above the working surface once the vertically-extending construction column, in use, is positioned on the working surface). The structure also includes (and is not limited to) a horizontal construction beam assembly having a beam-reference portion. The structure also includes (and is not limited to) a prop head assembly configured to be fixedly connected to the vertically-extending construction column. The prop head assembly is also configured to support, at least in part, the horizontal construction beam assembly once the prop head assembly is fixedly connected to the vertically-extending construction column.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

DETAILED DESCRIPTION OF THE DRAWINGS

The non-limiting embodiments may be more fully appreciated by reference to the following detailed description of the non-limiting embodiments when taken in conjunction with the accompanying drawings, in which:

FIG. 1 and FIG. 2 depict a perspective view (FIG. 1) and a close-up perspective view (FIG. 2) of embodiments of a prop head assembly; and FIG. 3, FIG. 4 and FIG. 5 depict a side view (FIG. 3), a side view (FIG. 4), and an end view (FIG. 5) of embodiments of a beam configured to be utilized with an embodiment of the prop head assembly of FIG. 1 and/or FIG. 2; and FIG. 6 and FIG. 7 depict perspective views of embodiments of a beam end support of the embodiments of the beam of any one of FIG. 3, FIG. 4 and FIG. 5; and FIG. 8 and FIG. 9 depict a side view (FIG. 8) and a side view (FIG. 9) of embodiments of the prop head assembly of any one of FIG. 1 and FIG. 2; and FIG. 10, FIG. 11 and FIG. 12 depict side views of embodiments of the prop head assembly of FIG. 8; and FIG. 13 depicts a perspective view of an embodiment of the prop head assembly of FIG. 8; and FIG. 14 depicts an exploded perspective view of an embodiment of the prop head assembly of FIG. 8; and FIG. 15 and FIG. 16 depict perspective views of embodiments of the prop head assembly of FIG. 8; and FIG. 17 depicts a partial perspective view of an embodiment of the prop head assembly of FIG. 16; and FIG. 18 depicts a perspective view of an embodiment of the prop head assembly of FIG. 8; and FIGS. 19-22 depict cross-sectional views of embodiments of the prop head assembly of FIG. 19; and FIG. 23 depicts a cross-sectional view of an embodiment of the prop head assembly of FIG. 19; and FIG. 24 depicts a side view of an embodiment of the prop head assembly of FIG. 9; and FIG. 25 depicts a perspective view of an embodiment of the prop head assembly of FIG. 9; and FIG. 26 depicts an exploded perspective view of an embodiment of the prop head assembly of FIG. 9; and FIG. 27 and FIG. 28 depict perspective views of embodiments of the prop head assembly of FIG. 25; and FIG. 29 depicts a cross-sectional view of an embodiment of the prop head assembly of FIG. 28; and FIG. 30 depicts a cross-sectional view of an embodiment of the prop head assembly of FIG. 28.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
102 prop head assembly
104 first beam-locating feature
105 first stationary position
106 second beam-locating feature
107 second stationary position
110 shackle assembly
112 prop base

114 load-receiving feature
202 first prop head assembly
250 height
302 second prop head assembly
304 first support element
306 second support element
308 lower portion
310 upper portion
350 height
502 first locator plate assembly
504 second locator plate assembly
700 structure
701 working surface
703 structural wall
802 first horizontal construction beam assembly, or primary beam
804 second horizontal construction beam assembly, or cross-beam
900 vertically-extending construction column, or column
901 stability wire
902 horizontal construction beam assembly, or beam
903 column portion
904 beam-reference portion
905 beam-terminus receiver
906 beam end support
907 beam lock assembly
907A first beam lock assembly
907B second beam lock assembly
908 guide feature
909 lock receiver
912 angle
914 lock device
916 lock retainer
918 cavity
920 prop receiver
922 sidewall
950 concrete slab
952 frame assembly
954 frame-engagement device

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

FIG. 1 and FIG. 2 depict a perspective view (FIG. 1) and a close-up perspective view (FIG. 2) of embodiments of a prop head assembly 102. The prop head assembly 102 is configured to support (at least in part) a structure 700, and/or to provide assistance for the support of the weight of (or an aspect of) the structure 700 (or an aspect of the structure 700).

In accordance with the embodiment as depicted in FIG. 1 and FIG. 2, an apparatus 100 is provided for a column 900, and any equivalent thereof. The apparatus 100 is also provided for a horizontal construction beam assembly 902 (and any equivalent thereof) having a beam-reference portion 904 (and any equivalent thereof, such as a beam pin, etc.). For the sake of easing the detailed description of the embodiments, the horizontal construction beam assembly 902 will be referred to as the beam 902. The beam-reference portion 904 may be called a beam-terminus location, a pin, or a beam pin, etc., and any equivalent thereof. The apparatus 100 includes and is not limited to (comprises) a prop head assembly 102. The prop head assembly 102 is configured to be utilized (for construction) and/or installed (in combination with the column 900 and beam 902) in a structure 700 to be constructed (such as, a building, a bridge, etc., and any equivalent thereof). An embodiment of the structure 700 is partially depicted (under construction) in the embodiment of FIG. 1. The structure 700 may include (and is not limited to) a home, a building, a vessel, a bridge, a trench, a man-made formation, etc., and any equivalent thereof.

Referring to the embodiment as depicted in FIG. 1, the prop head assembly 102, preferably, is provided for the column 900. An embodiment of the column 900 is partially depicted in the embodiment of FIG. 1. The column 900 is to be utilized or installed in the structure 700. For the sake of easing the detailed description of the embodiments, the vertically-extending construction column 900 is hereafter referred to as the column 900.

The structure 700 includes a working surface 701 (such as, a horizontal structural floor) on which the column 900 is positioned and extends therefrom. The structure 700 includes at least one instance of a structural wall 703 (also called a vertically extending wall). The vertically-extending construction column 900 is configured to be positionable on the working surface 701 (this is done in such a way that the vertically-extending construction column 900, in use, extends vertically above the working surface 701 once the vertically-extending construction column 900, in use, is positioned on the working surface 701).

Referring to the embodiment as depicted in FIG. 1, the prop head assembly 102, preferably, is provided for the beam 902 having the beam-reference portion 904. The beam 902 is to be utilized (in the construction of), or installed in, the structure 700.

Referring to the embodiment as depicted in FIG. 1, the prop head assembly 102, preferably, is configured to be fixedly connected to the column 900. The prop head assembly 102 is also configured to support, at least in part, the beam 902 (once the prop head assembly 102 is fixedly connected to the column 900). Preferably, the prop head assembly 102 is configured to be fixedly connectable to a top section (distal end section) of the column 900. More preferably, the prop head assembly 102 is configured to be fixedly connected to the column 900 in such a way that the prop head assembly 102 is not selectively movable along a length of the column 900.

Referring to the embodiment as depicted in FIG. 1, a concrete slab 950 is formed (positioned) in a frame assembly 952 (for instance, this is done by pouring cement into the frame assembly 952, and allowing the cement to harden to form the concrete slab 950). The beam 902 includes a frame-engagement device 954. The frame-engagement device 954 may be called or include upstanding ribs, a row of ribs, a double row of spaced apart ribs, etc., and any equivalent thereof. The frame-engagement device 954 extends, at least in part, along a length of the top section of beam 902. The frame-engagement device 954 is configured to selectively and securely engage with a lower section of the frame assembly 952. Preferably, the frame assembly 952 defines spaced apart channels configured to receive the ribs of the frame-engagement device 954. This is done in such a way that the frame assembly 952, in use, securely spans across and between (and selectively engages with) spaced apart instances of the beam 902 (which are aligned parallel with each other). In this way, a horizontal floor section may be constructed for the structure 700.

Referring to the embodiment as depicted in FIG. 1, the prop head assembly 102, the beam 902 and the column 900 include strength components, such as metal components, made with a suitable material or materials (such as, a metal alloy, etc.) having sufficient strength characteristics needed to support the structure 700 (once the structure 700 is built). For instance, the strength component may include steel, wood, and/or reinforced concrete, etc.

Referring to the embodiment as depicted in FIG. 2, the beam 902 includes (or is) a first horizontal construction beam assembly 802. The first horizontal construction beam assembly 802 is a beam used as a main horizontal support in a structure. The first horizontal construction beam assembly 802 may be called (or is) a primary beam, a primary beam support, a girder, etc., and any equivalent thereof. For the sake of easing the detailed description of the embodiments, the first horizontal construction beam assembly 802 will be referred to as the primary beam 802.

The beam 902 includes (or is) a second horizontal construction beam assembly 804. The second horizontal construction beam assembly 804 is a horizontal structural beam that runs (is aligned) perpendicular to the primary beam 802. The second horizontal construction beam assembly 804 may be called (or is) a secondary beam, a secondary girder, a crossbeam, a transverse beam, etc., and any equivalent thereof. For the sake of easing the detailed description of the embodiments, the second horizontal construction beam assembly 804 will be referred to as the crossbeam 804.

The primary beam 802 (the primary beam) and the crossbeam 804 (the secondary beam or the cross beam) are to be positioned orthogonal relative to each other on a horizontal plane (forming a matrix pattern having matrix junctions as depicted in the embodiments of FIG. 1 and/or FIG. 2), on which the horizontal structural floor (as depicted in the embodiment of FIG. 1), which is formed by a plurality of the frame assembly 952 and the concrete slab 950, is positioned (securely positioned) thereon.

Referring to the embodiment as depicted in FIG. 2, the prop head assembly 102 may be utilized or deployed for at least three scenarios or cases.

For instance, in accordance with a first deployment scenario (which is depicted in the embodiment of FIG. 10 and/or the embodiment of FIG. 12), the prop head assembly 102 is positioned underneath a junction zone (matrix junction), in which the junction zone is positioned below (and supports) the end portions of end-to-end facing instances (the end portions) of the beam 902 (or the primary beam 802 or the crossbeam 804, as the case may be) are positioned to face each other in an end-to-end relationship (preferably at about 90 degrees relative to each construction beam in an orthogonal relationship). Preferably, the end portions of the instance of the beam 902 are positioned adjacent to each other in a close relationship (a proximate relationship or adjacent spatial position).

For instance, in accordance with a second deployment scenario (which is depicted in the embodiment of FIG. 11), the prop head assembly 102 is positioned underneath (and contacts and supports) the bottom section of the beam 902, such as midway between the end sections of the beam 902 (or the primary beam 802 or the crossbeam 804, as the case may be).

For instance, in accordance with a third deployment scenario (which is depicted in the embodiment of FIG. 24 and/or the embodiment of FIG. 27), the prop head assembly 102 is positioned underneath (and supports) a junction zone, in which the junction zone is positioned below (and supports) the end portion of the crossbeam 804, and the end portion of the crossbeam 804 is positioned to face a sidewall of the primary beam 802. Preferably, the end portion of the crossbeam 804 is positioned adjacent to the sidewall of the primary beam 802 in a close relationship or a proximate relationship.

FIG. 3, FIG. 4 and FIG. 5 depict a side view (FIG. 3), a side view (FIG. 4), and an end view (FIG. 5) of embodiments of a beam 902 configured to be utilized with (or installed to) an embodiment of the prop head assembly 102 of FIG. 1 and/or FIG. 2.

Referring to the embodiments as depicted in FIG. 3 and/or FIG. 4, the beam 902 has (includes) opposite end portions. Each of the opposite end portions includes a beam-reference portion 904 and a beam end support 906. The beam-reference portion 904 is configured to be selectively spatially located proximate to any one of the first beam-locating feature 104 and the second beam-locating feature 106 of the prop head assembly 102 (which are depicted in the embodiment of FIG. 8 and/or the embodiment of FIG. 9). The beam end support 906 is affixed to the end portions of beam 902. The beam-reference portion 904 is positioned (located) in the beam end support 906. The beam end support 906 is positioned at the opposite end sections (opposite end portions) of beam 902. The beam end support 906 is configured to receive and support the beam-reference portion 904. The beam 902 is configured to securely receive and hold the beam end support 906 at the spaced apart distal end sections of beam 902. The weight of the beam 902 is to be transferred (at least in part) to the opposite ends of the beam 902 to the beam end support 906 (which is positioned at the opposite ends of beam 902). The weight of the beam 902 is transferred (at least in part) to the prop head assembly 102 via the beam end support 906 (which is positioned at the opposite ends of beam 902).

Preferably, the weight of the horizontal construction beam assembly 902 is transferred, at least in part, to the prop head assembly 102 via the beam end support 906, in which the beam end support 906 is positioned at the opposite ends of the horizontal construction beam assembly 902 (once the beam end support 906 of the horizontal construction beam assembly 902, in use, contacts, at least in part (either directly or indirectly), the prop head assembly 102).

Referring to the embodiment as depicted in FIG. 3, the beam 902 includes a primary beam 802. The primary beam 802 includes a beam-reference portion 904 and a beam end support 906. The primary beam 802 has, preferably, a flat end portion that is aligned parallel to the vertical direction (once the primary beam 802 is positioned horizontally or along a horizontal direction).

Referring to the embodiment as depicted in FIG. 4, the beam 902 includes a crossbeam 804 (also called a cross beam). In accordance with an option, the end sections of the primary beam 802 (as depicted in the embodiment of FIG. 3) and the crossbeam 804 may be the same shape or profile, etc., if so desired. The crossbeam 804 includes a beam-reference portion 904 and a beam end support 906. The crossbeam 804 has, preferably, a tapered end portion that is aligned at an angle 912 that intersects the vertical direction (once the crossbeam 804 is positioned horizontally or along the horizontal direction).

Referring to the embodiments as depicted in FIG. 3 and/or FIG. 4, a preferred difference between the primary beam 802 (as depicted in the embodiment of FIG. 3) and the crossbeam 804 (as depicted in the embodiment of FIG. 4) is that the primary beam 802 has, preferably, a flat end portion (for the opposite end sections of the primary beam 802), while the crossbeam 804 has, preferably, a tapered end portion (for the opposite end sections of the crossbeam 804). The reason for the tapered end section of the crossbeam 804 is evident in view of the embodiment as depicted in FIG. 12, in which case the end portion of the crossbeam 804 is tapered to avoid physical interference with the primary beam 802 once the crossbeam 804 and the primary beam 802 are mounted to the prop head assembly 102 (or the first prop head assembly 202).

Referring to the embodiments as depicted in FIG. 3 and/or FIG. 4, the description for the embodiments of beam 902, the primary beam 802 and/or the crossbeam 804 is applicable (at least in part) to beam 902, the primary beam 802, and the crossbeam 804, if so desired to suit a specific requirement or configuration.

Referring to the embodiment as depicted in FIG. 5, the beam end support 906 defines (provides) a beam-terminus receiver 905 (also called a channel, a groove, and any equivalent thereof) configured to receive (slidably receive), at least in part, the beam-reference portion 904 into the interior of the beam end support 906. The beam 902 includes a sidewall 922 (oppositely positioned sidewalls).

Referring to the embodiment as depicted in FIG. 5, the beam 902 includes the frame-engagement device 954. The frame-engagement device 954 of the beam 902 (and/or the primary beam 802 and/or the crossbeam 804, as the case may require) is configured to engage the bottom portion or bottom section of the frame assembly 952 having the concrete slab 950.

Referring to the embodiment as depicted in FIG. 5, the beam 902 (the primary beam 802 and the crossbeam 804) has a rectangular cross-sectional profile. The beam 902 is configured to receive and support the beam end support 906. The beam-reference portion 904 is configured to be received in the interior of the beam end support 906 (preferably via the beam-terminus receiver 905 defined by the beam end support 906).

Referring to the embodiments as depicted in FIG. 3, FIG. 4 and/or FIG. 5, the beam end support 906 is configured to be affixed to the end portion of beam 902. For instance, the beam end support 906 may be welded to the end portion of beam 902, etc.

FIG. 6 and FIG. 7 depict perspective views of embodiments of a beam end support 906 of the embodiments of the beam 902 of any one of FIG. 3, FIG. 4 and FIG. 5.

Referring to the embodiments as depicted in FIG. 6 and FIG. 7, the beam end support 906 provides (defines) a cavity 918 (hollow interior that is accessible from the exterior). This is done in such a way that the cavity 918, in use, exposes the beam-reference portion 904 to the exterior once the beam-reference portion 904 is received by the beam end support 906. In this manner, the beam-reference portion 904 may make contact with a portion of the prop head assembly 102 (or with the first prop head assembly 202 or the second prop head assembly 302, as the case may be, with reference to the embodiments as depicted in FIG. 8 and FIG. 9, which depict embodiments of the prop head assembly 102).

The beam end support 906 may be integrated with (to) the beam 902 (as depicted in the embodiment of FIG. 3). For convenience, the beam end support 906 is machined with specific features for interacting with the beam-reference portion 904 and the beam lock assembly 907. The beam lock assembly 907 is configured to selectively lock (or unlock) the beam 902 to the prop head assembly 102. The beam lock assembly 907 includes a lock device 914 (such as a pin, etc., and any equivalent thereof) and a lock retainer 916 (such as a spring assembly, etc., and any equivalent thereof). The beam end support 906 provides a guide feature 908 that is configured to mate with a groove or a portion of beam 902, etc.

FIG. 8 and FIG. 9 depict a side view (FIG. 8) and a side view (FIG. 9) of embodiments of the prop head assembly 102 of any one of FIG. 1 and FIG. 2.

Referring to the embodiments as depicted in FIG. 8 and FIG. 9, the prop head assembly 102 may be configured or classified as two types of prop head assemblies, depending on the design requirements.

Referring to the embodiment as depicted in FIG. 8, the prop head assembly 102 may be called (includes) a first prop head assembly 202. FIG. 8 and FIG. 10 to FIG. 23 depict the embodiments of the first prop head assembly 202. The first prop head assembly 202 is configured to receive, at least in part, the weight of the beam 902 from (via the beam end support 906). Preferably, the first prop head assembly 202 is configured to receive, at least in part, the weight of at least one instance of the beam 902 from (via the beam end support 906). Preferably, the first prop head assembly 202 is configured to receive, at least in part, the weight of one instance, two instances, three instances or four instances of the beam 902 from (via the beam end support 906 of the beam 902).

Referring to the embodiment as depicted in FIG. 9, the prop head assembly 102 may be called (includes) a second prop head assembly 302. FIG. 9 and FIG. 24 to FIG. 30 depict the embodiments of the second prop head assembly 302. A portion or a section of the second prop head assembly 302 is configured to receive, at least in part, the weight of the beam 902 from a section of the beam 902 that is located between the opposite end portions of the beam 902 (and the beam end support 906 does not contact the second prop head assembly 302, for this case). Another portion or section of the second prop head assembly 302 is configured to receive, at least in part, the weight of the beam 902 from (via the beam end support 906), if so desired or required (depending on the formation of the support matrix as depicted in the embodiment of FIG. 2). Preferably, the second prop head assembly 302 is configured to (A) receive, at least in part, the weight of one instance or two instances of the beam 902 from (via the beam end support 906), and (B) receive, at least in part, the weight of an instance of the beam 902 from a section (a portion) of the beam 902 that is located between the opposite end portions of the beam 902.

Referring to the embodiments as depicted in FIG. 8 and FIG. 9, the first prop head assembly 202 and the second prop head assembly 302 are positionable at selected junctions of a matrix pattern having matrix junctions formed (as depicted in FIG. 2) by the primary beam 802 (the primary beam) and the crossbeam 804 (the secondary beam or the cross beam), which are positionable orthogonal relative to each other on a horizontal plane forming the matrix pattern having the matrix junctions, on which the horizontal structural floor (as depicted in FIG. 1), which is formed by a plurality of the frame assembly 952 and the concrete slab 950, is positioned (securely positioned) thereon.

Referring to the embodiment as depicted in FIG. 8, the first beam-locating feature 104 is, preferably, configured to form a U-shaped formation that opens vertically upwardly (along an axial direction relative to the longitudinal axis extending through the column 900). The second beam-locating feature 106 is, preferably, configured to form a U-shaped formation that opens horizontally sideways (along a radial direction relative to the longitudinal axis extending through the column 900).

Referring to the embodiment as depicted in FIG. 9, the first beam-locating feature 104 is, preferably, configured to form a L-shaped formation that faces the column 900 (that opens vertically upwardly and radial toward the column 900). The second beam-locating feature 106 is, preferably, configured to form a U-shaped formation that opens horizontally sideways (along a radial direction relative to the longitudinal axis extending through the column 900).

Referring to the embodiments as depicted in FIG. 8 and FIG. 9, the first prop head assembly 202 has a height 250. The second prop head assembly 302 has a height 350. Preferably, the height 250 of the first prop head assembly 202 and the height 350 of the second prop head assembly 302 are such that the top section of the beam 902 (or the primary beam 802 or the crossbeam 804, as the case may be) is at the same vertical height above the working surface 701 (once the beam 902 is mounted to the prop head assembly 102, the first prop head assembly 202, or the second prop head assembly 302, as the case may be).

FIG. 10, FIG. 11 and FIG. 12 depict side views of embodiments of the prop head assembly 102 of FIG. 8.

Referring to the embodiments as depicted in FIG. 10 and FIG. 12, a first deployment scenario includes the case where the prop head assembly 102 is positioned underneath a junction zone (a matrix junction), in which the junction zone is positioned below (and supports) the end portions of end-to-end facing instances of the primary beam 802 or the crossbeam 804, as the case may be) that are positioned to face each other in an end-to-end relationship. Preferably, the end portions of the primary beam 802 are positioned adjacent to each other in a close relationship or a proximate relationship.

Referring to the embodiment as depicted in FIG. 11, a second deployment scenario includes the case where the prop head assembly 102 is positioned underneath (contacts and supports) the bottom section of the beam 902 between the end portions or end sections of the beam 902 (such as midway between the end sections of the beam 902 (or the primary beam 802 or the crossbeam 804, as the case may be). For this case, the beam 902 defines a prop receiver 920 (channel, groove, etc.) configured to receive, at least in part, a portion of the prop head assembly 102 (or the first prop head assembly 202 or the second prop head assembly 302, as the case may be).

Referring to the embodiment as depicted in FIG. 11, the beam 902 defines a prop receiver 920 (cavity, groove, channel) that is located along the bottom side of beam 902. The prop receiver 920 of the beam 902 is configured to receive, at least in part, the prop head assembly 102 (so that the prop head assembly 102 is positioned between the end portions (end terminals) of the beam 902 once the prop receiver 920, in use, receives, at least in part, the prop head assembly 102).

Referring to the embodiment as depicted in FIG. 12, the end section of the crossbeam 804 forms a tapered section at the angle 912. The tapered end section or portion of the crossbeam 804 is configured to prevent physical conflicts or interference for the case where the crossbeam 804 is positioned proximate to the primary beam 802. The reason for the tapered end section of the crossbeam 804 is evident in view of the embodiment as depicted in FIG. 12, in which case the end portion of the crossbeam 804 is tapered to avoid physical interference with the primary beam 802 once the crossbeam 804 and the primary beam 802 are mounted to the prop head assembly 102 (or the first prop head assembly 202).

Referring to the embodiment as depicted in FIG. 12, the beam lock assembly 907 is configured to be installed to (received by) the second beam-locating feature 106 of the prop head assembly 102. The beam lock assembly 907 is configured to selectively securely lock the beam 902 to the prop head assembly 102 (at the second beam-locating feature 106). The beam-reference portion 904 of the beam 902 is received (located) at the first beam-locating feature 104 of the prop head assembly 102.

Figure 13:
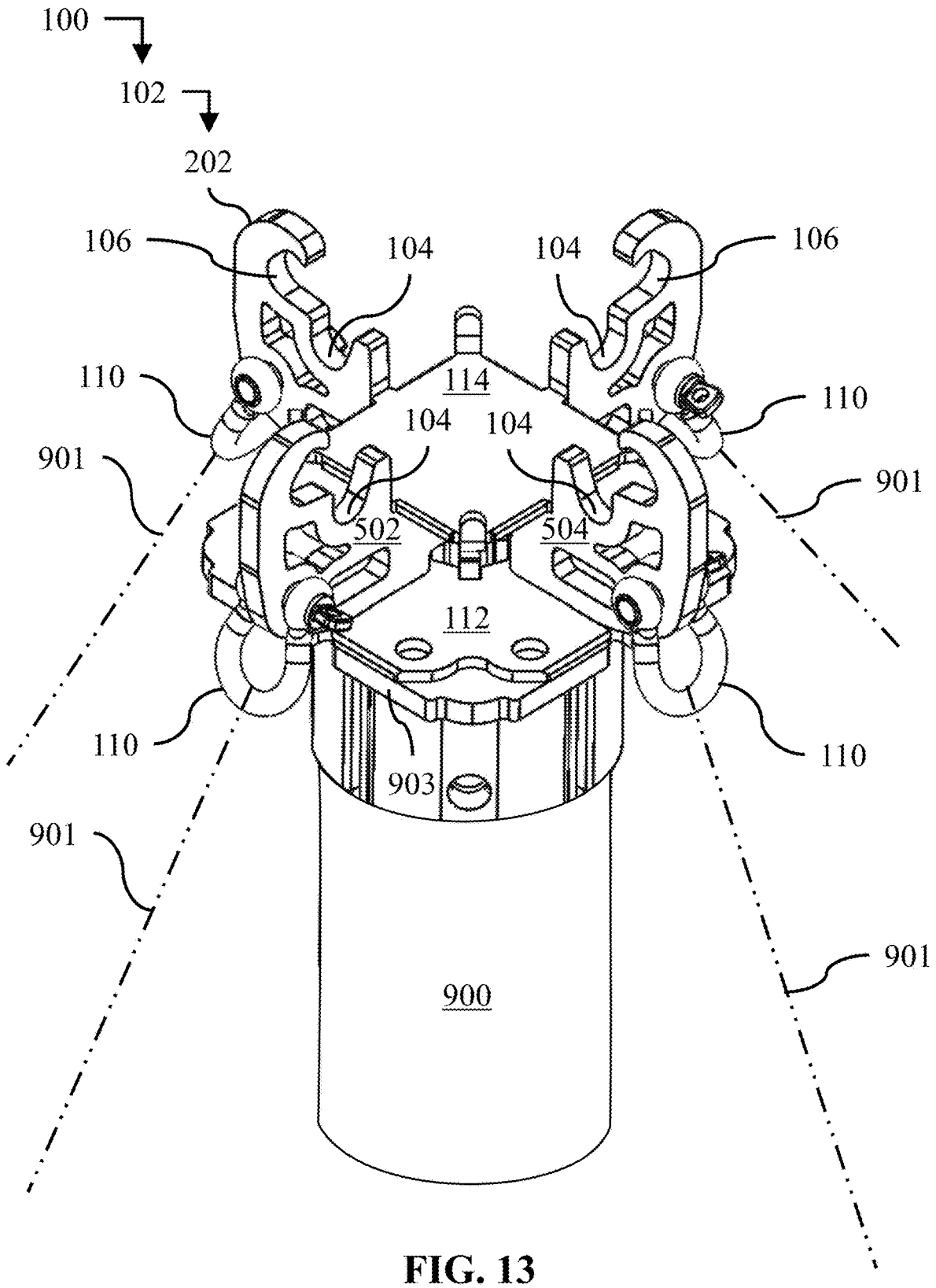
FIG. 13 depicts a perspective view of an embodiment of the prop head assembly 102 of FIG. 8.

Referring to the embodiment as depicted in FIG. 13, the first beam-locating feature 104 may be called a first locator, and any equivalent thereof. The second beam-locating feature 106 may be called a second locator, a safety catch, a hook formation, and any equivalent thereof.

Referring to the embodiment as depicted in FIG. 13, the prop head assembly 102 is configured to be coupled to a shackle assembly 110 (and any equivalent thereof). Preferably, the corner portions of the prop head assembly 102 are configured to couple to a shackle assembly 110. A stability wire 901 is affixed to each shackle assembly 110 in such a way that the stability wire 901 stabilizes the position of the prop head assembly 102 (once the prop head assembly 102 is affixed to the top section of the column 900, and the stability wire 901 is affixed to each shackle assembly 110).

Figure 14:
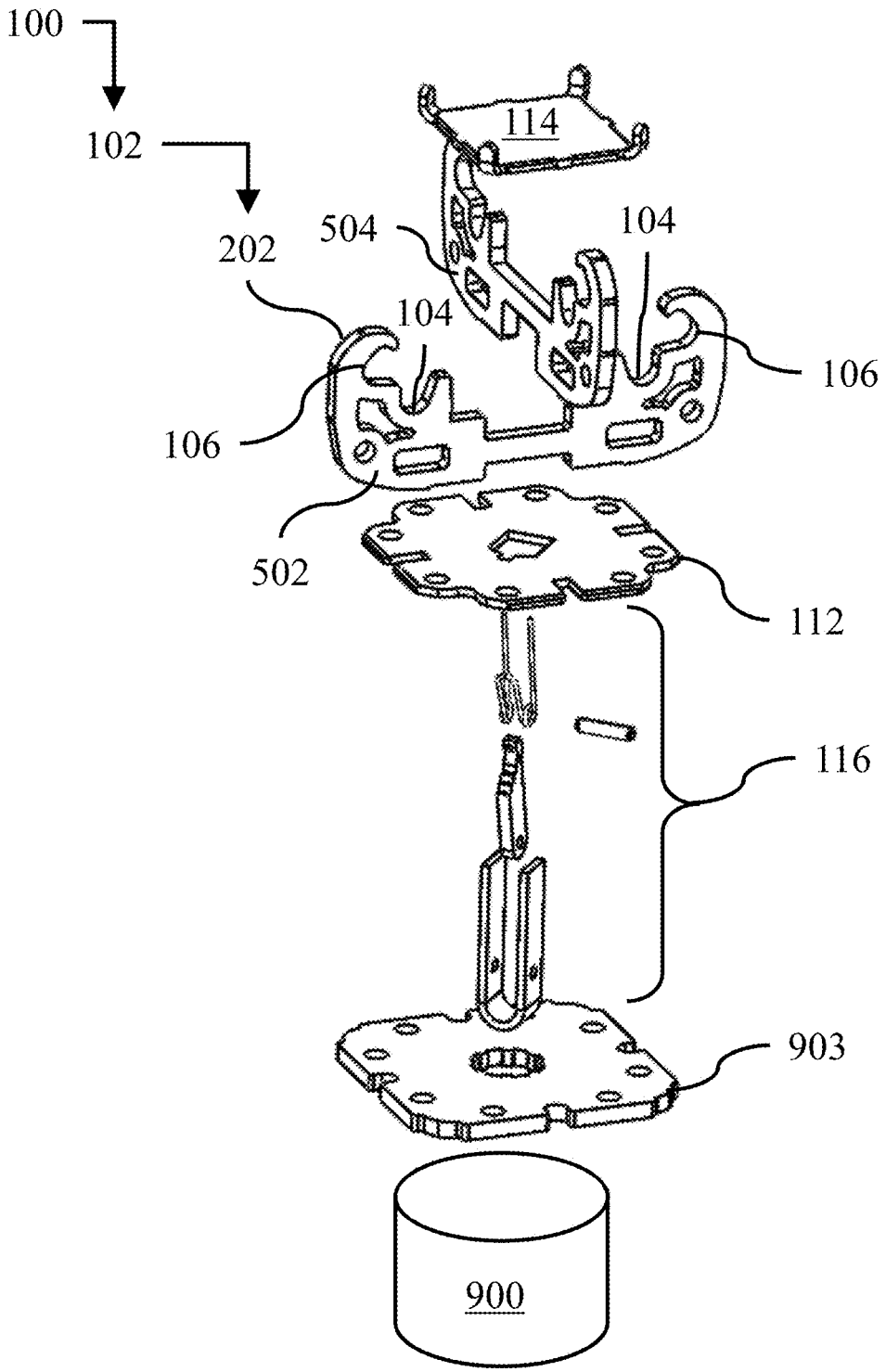
FIG. 14 depicts an exploded perspective view of an embodiment of the prop head assembly 102 of FIG. 8.

Referring to the embodiments as depicted in FIG. 13 and FIG. 14, the prop head assembly 102 (or the first prop head assembly 202) includes a prop base 112, and a load-receiving feature 114 (also called a reference plate or a reference feature). The prop base 112 is configured to be affixed to a column portion 903 (also called a column plate) of beam 902. The column portion 903 is affixed to the top portion of beam 902. The load-receiving feature 114 is positioned above the prop base 112. The load-receiving feature 114 is coupled (either directly or indirectly) to the prop base 112. The load-receiving feature 114 is configured to receive and support the load (the weight) of beam 902, preferably at a central zone of the load-receiving feature 114. The load-receiving feature 114 is configured to support, in use, the weight of the beam 902 or the beams to be placed and received by the prop head assembly 102, etc.

Referring to the embodiments as depicted in FIG. 13 and FIG. 14, the prop head assembly 102 (or the first prop head assembly 202) includes a first locator plate assembly 502 and a second locator plate assembly 504 that is positioned relative to the first locator plate assembly 502. Preferably, the first locator plate assembly 502 and the second locator plate assembly 504 are positioned at right angles to each other in an orthogonal relationship (relative to each other). The first locator plate assembly 502 and the second locator plate assembly 504 are (or include) formed plates. The shackle assembly 110 is configured to connect with (the lower sections of) the first locator plate assembly 502 and the second locator plate assembly 504. The first locator plate assembly 502 and the second locator plate assembly 504 each extends across, at least in part, the prop base 112. The load-receiving feature 114 is positioned centrally on the first locator plate assembly 502 and the second locator plate assembly 504. The first locator plate assembly 502 and the second locator plate assembly 504 are positioned on the prop base 112. Preferably, the components of the prop head assembly 102 are welded together (securely affixed together in a fixed relationship).

Referring to the embodiments as depicted in FIG. 13 and FIG. 14, the prop head assembly 102 includes (or is) the first prop head assembly 202. The first prop head assembly 202 includes a first locator plate assembly 502, and a second locator plate assembly 504. The first beam-locating feature 104 and the second beam-locating feature 106 provided by the first locator plate assembly 502 are positioned at the same level as the first beam-locating feature 104 and the second beam-locating feature 106 provided by the second locator plate assembly 504.

Referring to the embodiment as depicted in FIG. 14, a lock assembly 116 is configured to couple (securely connect) the prop base 112 (also called a prop base plate) to the column portion 903 and the vertically-extending construction column 900.

Figure 8:
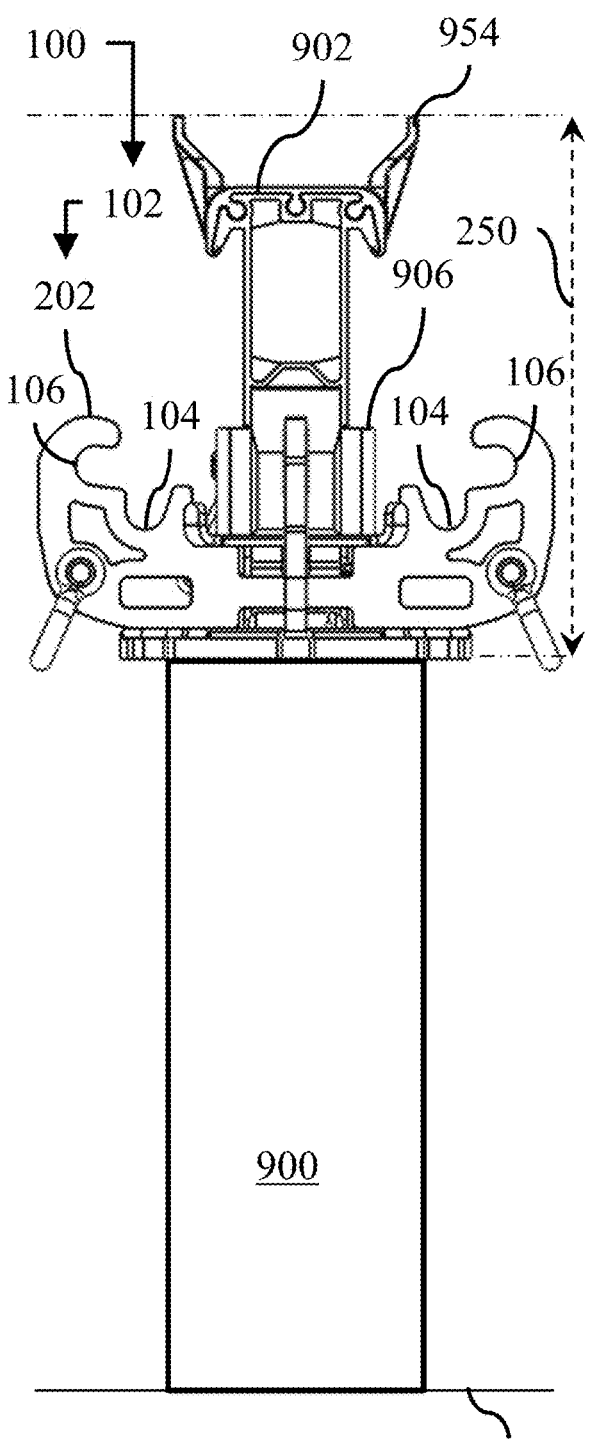
Figure 15:
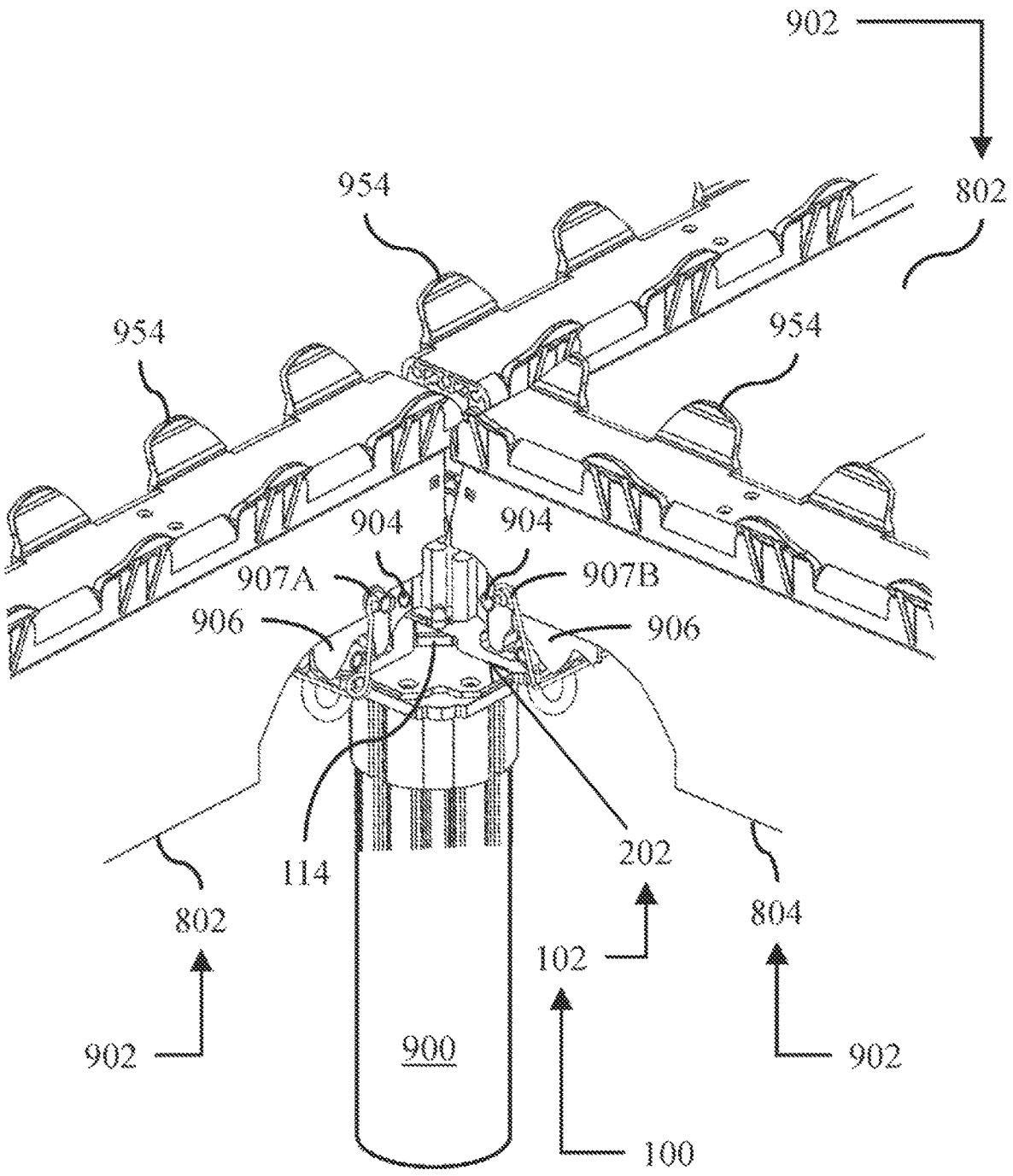
Figure 16:
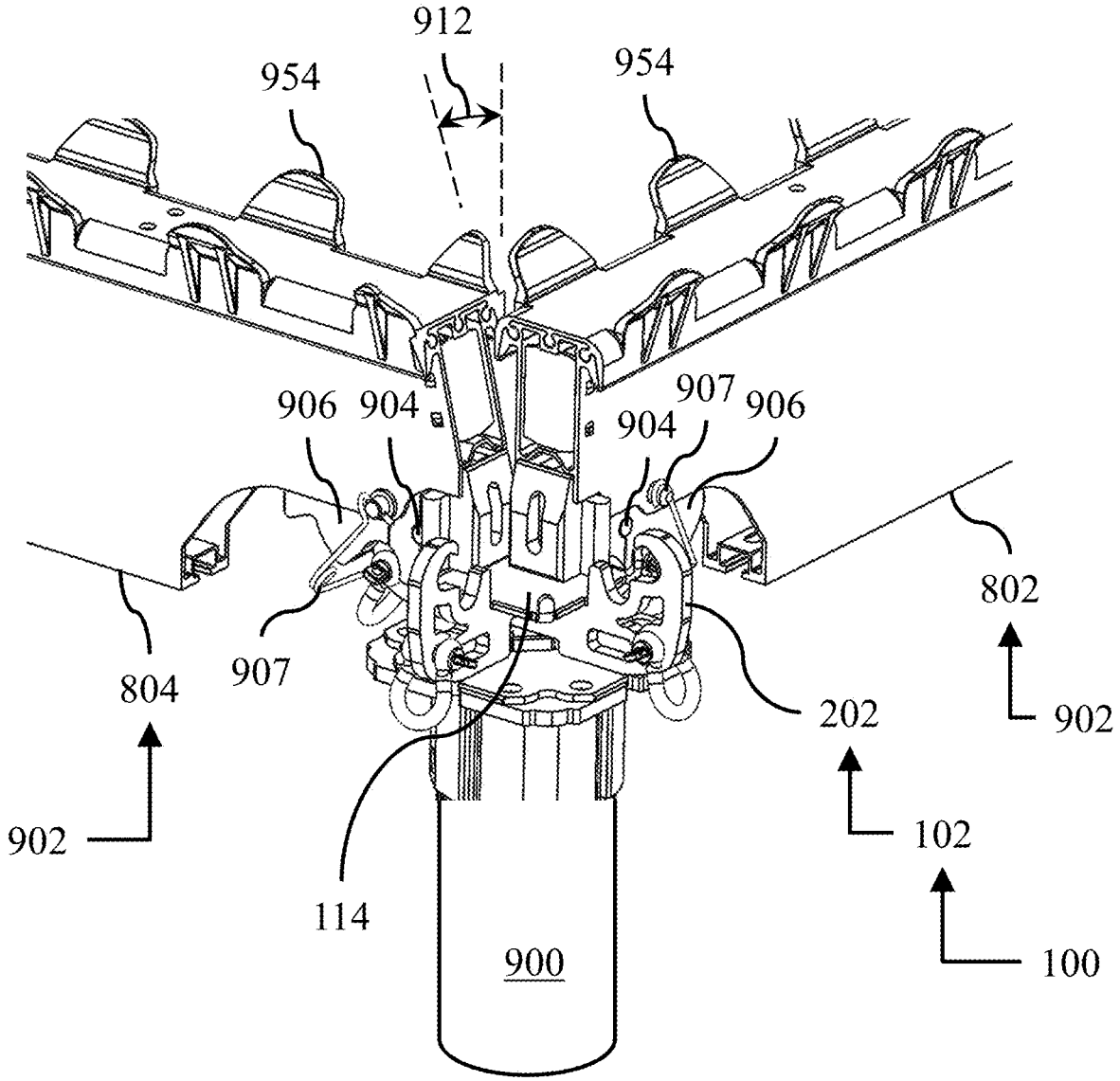

FIG. 15 and FIG. 16 depict perspective views of embodiments of the prop head assembly 102 of FIG. 8.

Referring to the embodiments as depicted in FIG. 15 and FIG. 16, the ends (distal ends or opposite end portions) of each the primary beams 802 are positioned at an end-to-end relationship (relative to each other), and an end portion of the crossbeam 804 faces the end portions of the primary beam 802. In this manner, the primary beam 802 and the crossbeam 804 are aligned orthogonally relative to each other. The prop head assembly 102 is configured to receive the end portions (more specifically, the beam-reference portion 904 that is mounted to the beam end support 906) of the primary beam 802 and the crossbeam 804. More specifically, the prop head assembly 102 is configured to receive the beam-reference portion 904 of the primary beam 802 and the beam-reference portion 904 of the crossbeam 804. The first beam lock assembly 907A is received by the primary beam 802, and the first beam lock assembly 907A, in use, locks the position of the primary beam 802 relative to the prop head assembly 102. The second beam lock assembly 907B is received by the crossbeam 804, and the second beam lock assembly 907B, in use, locks the position of the crossbeam 804 relative to the prop head assembly 102.

Referring to the embodiments as depicted in FIG. 16, the load-receiving feature 114, in use, supports (the weight of) the crossbeam 804. A lower portion of the beam end support 906 of the crossbeam 804, in use, contacts the load-receiving feature 114 (once the beam-reference portion 904 of the crossbeam 804 is placed on the first beam-locating feature 104 of the first prop head assembly 202). The first beam-locating feature 104 is hidden in this view (the embodiment of FIG. 8 depicts the first beam-locating feature 104).

Referring to the embodiments as depicted in FIG. 16, the load-receiving feature 114, in use, supports (the weight of) the primary beam 802. A lower portion of the beam end support 906 of the primary beam 802, in use, contacts the load-receiving feature 114 (once the beam-reference portion 904 of the primary beam 802 is placed on the first beam-locating feature 104 of the first prop head assembly 202). The first beam-locating feature 104 is hidden in this view (the embodiment of FIG. 8 depicts the first beam-locating feature 104).

Figure 17:
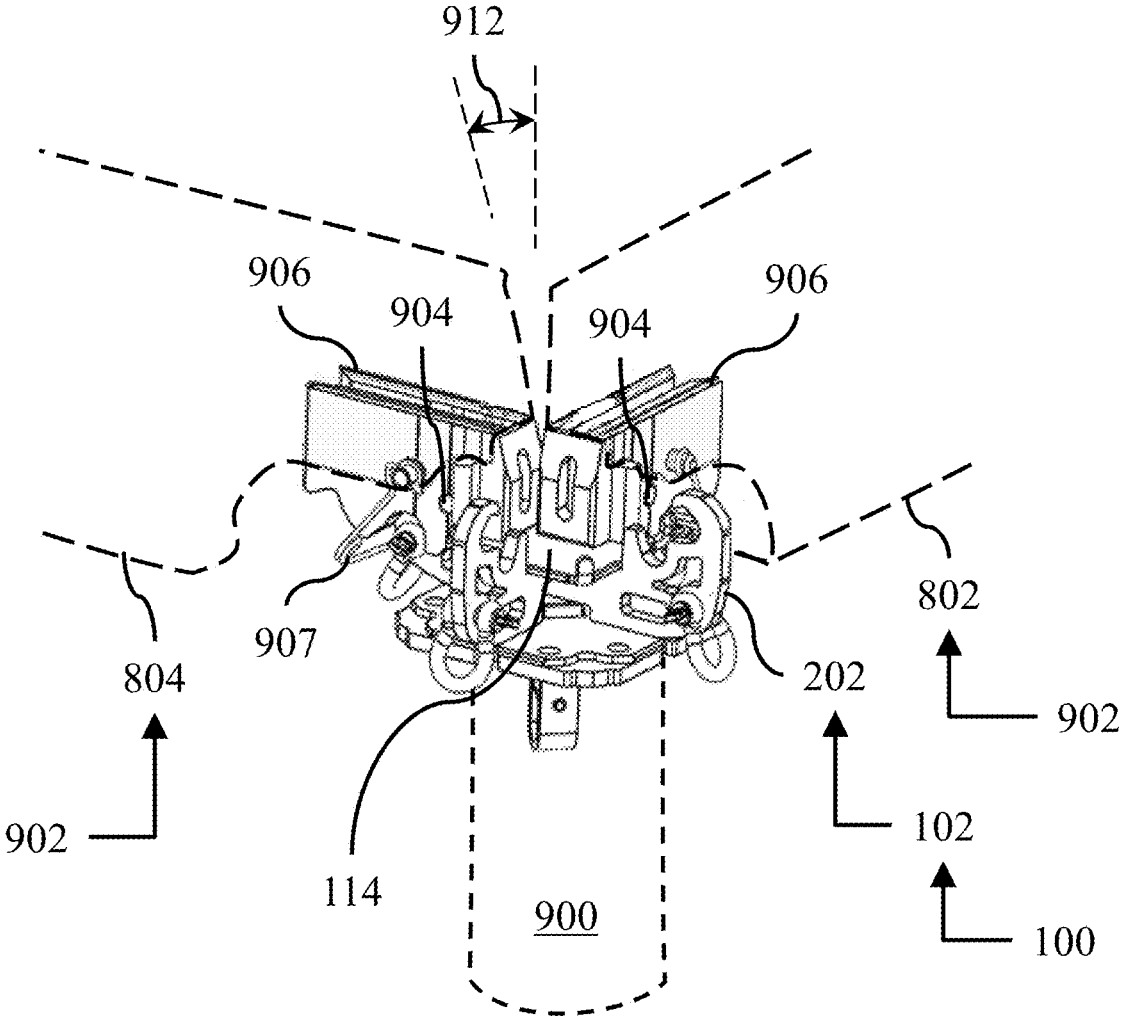

FIG. 17 depicts a partial perspective view of an embodiment of the prop head assembly 102 of FIG. 16.

Figure 9:
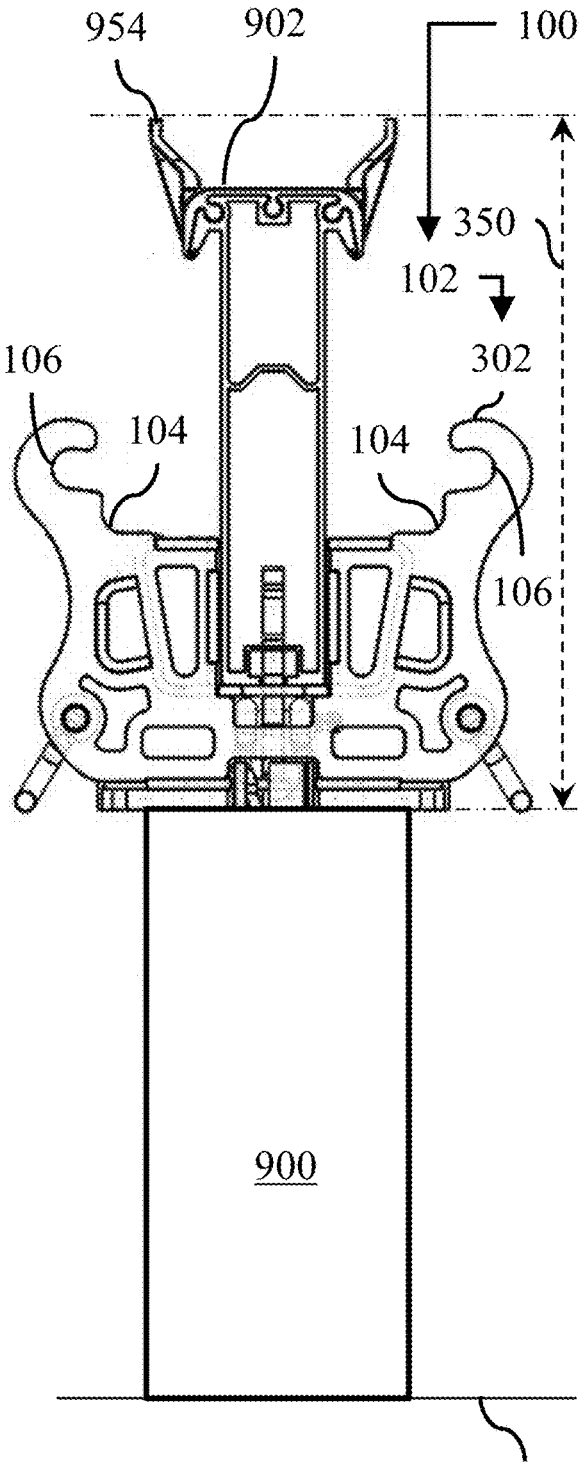
Figure 10:
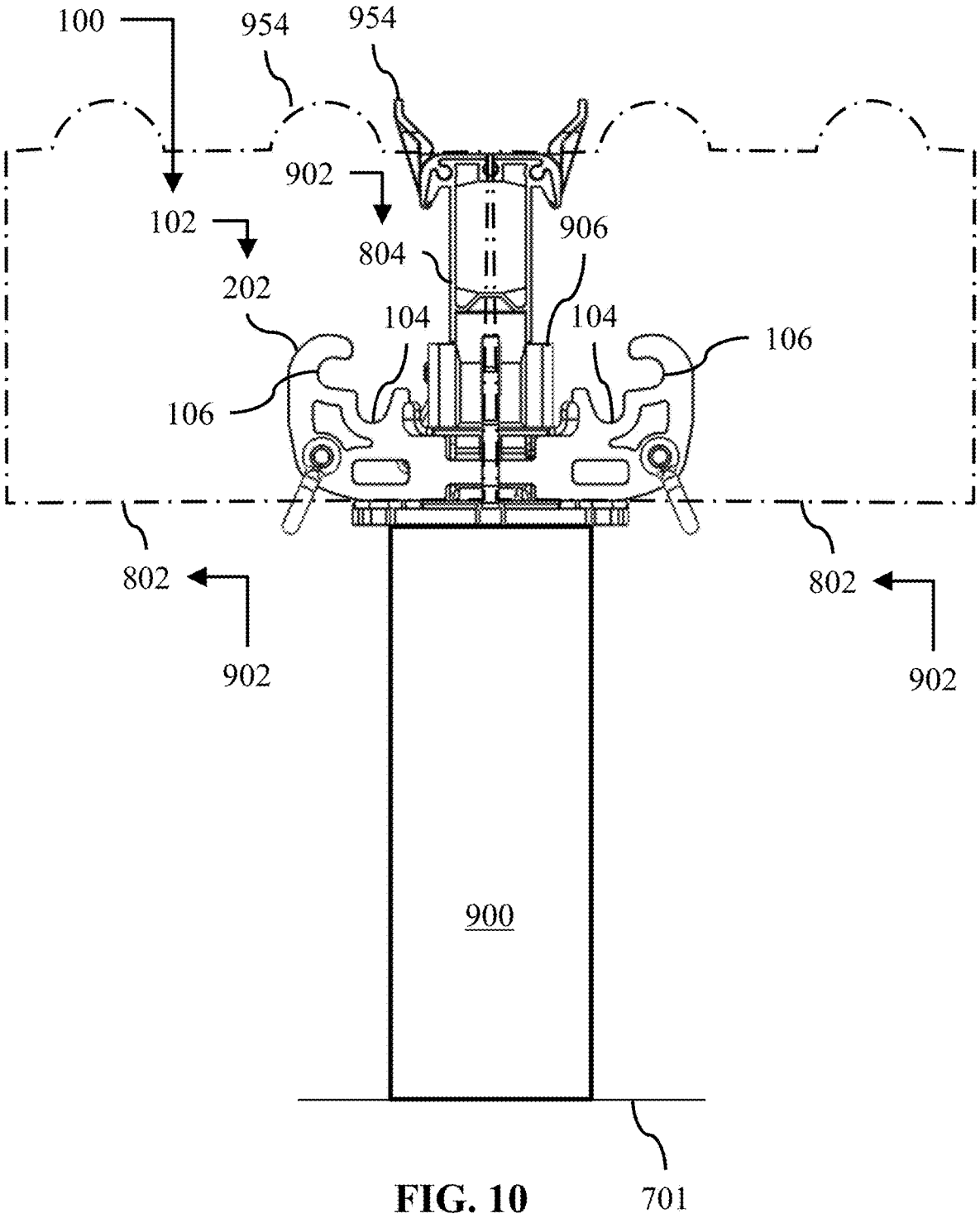
Figure 11:
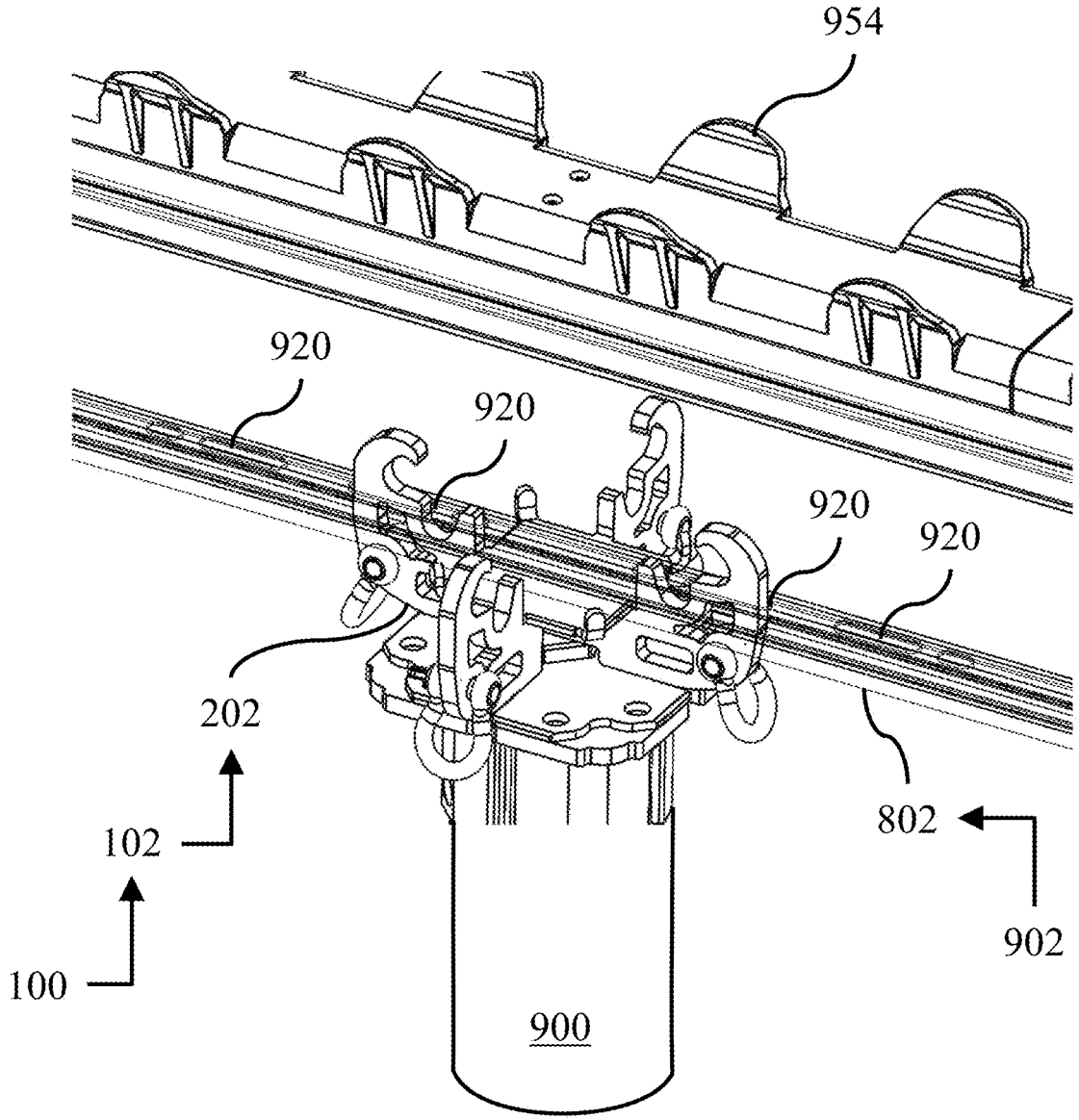
Figure 12:
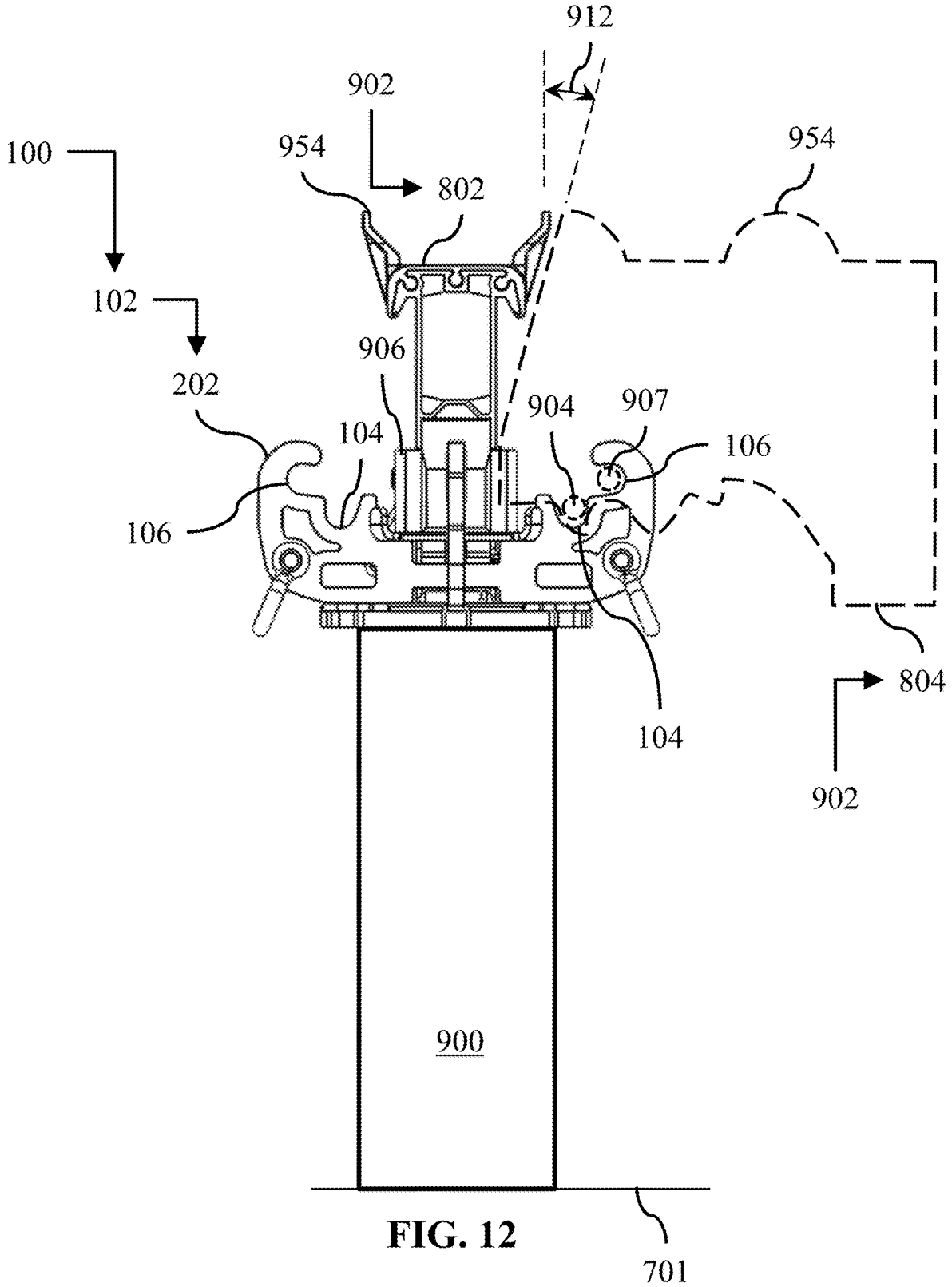

Referring to the embodiment as depicted in FIG. 17, the beam end support 906 of the primary beam 802, in use, receives the beam-reference portion 904. The beam-reference portion 904 is received in the first beam-locating feature 104 of the prop head assembly 102 (or the first prop head assembly 202, as the case may be). The first beam-locating feature 104 is hidden in this view of FIG. 17 (the embodiment of FIG. 9 depicts the first beam-locating feature 104). The beam end support 906 of the crossbeam 804, in use, receives the beam-reference portion 904, and the beam-reference portion 904 is received in the first beam-locating feature 104 of the prop head assembly 102 (or the first prop head assembly 202, as the case may be). The first beam-locating feature 104 is hidden in this view of FIG. 17 (the embodiment of FIG. 9 depicts the first beam-locating feature 104).

Figure 18:
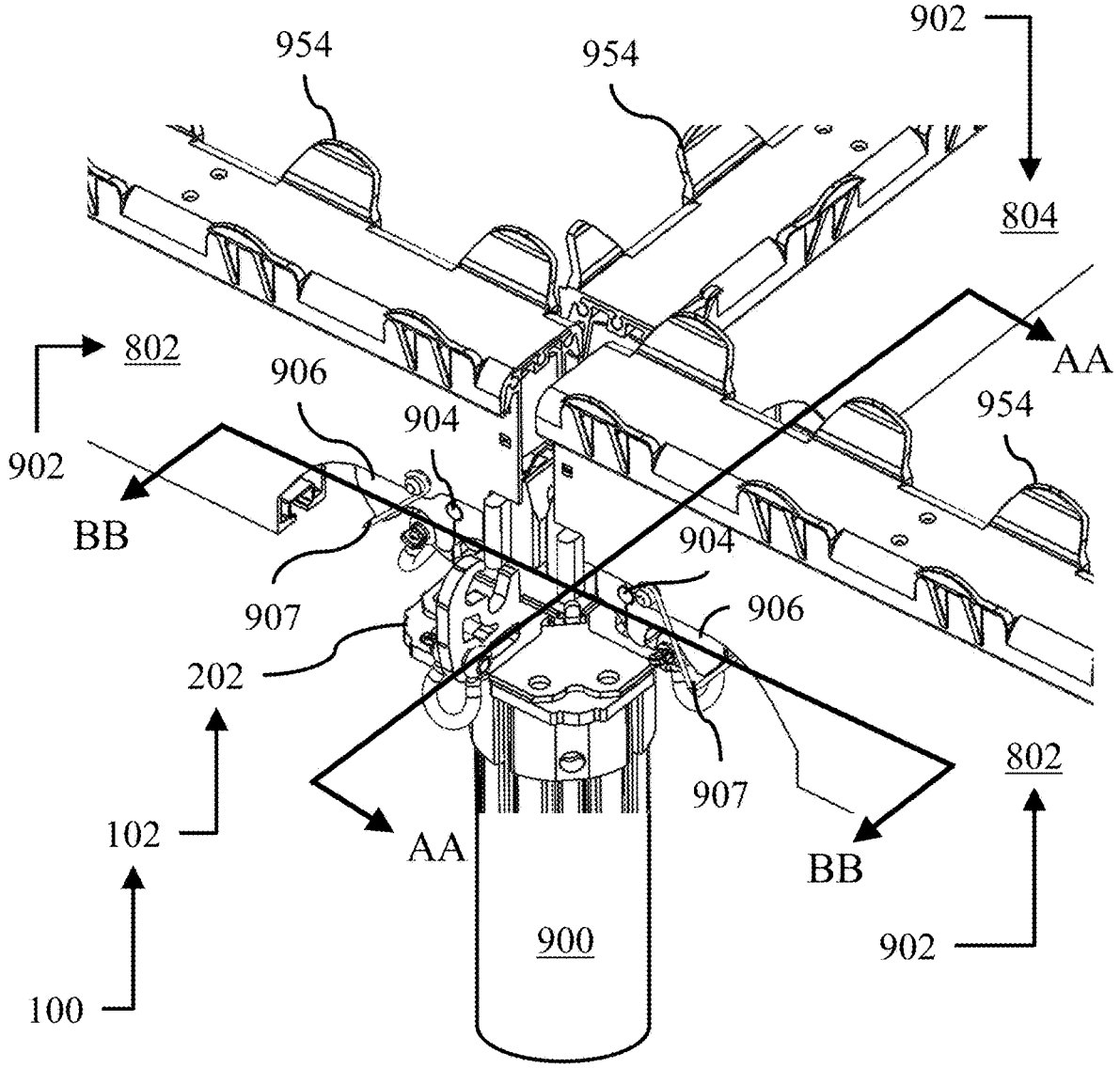

FIG. 18 depicts a perspective view of an embodiment of the prop head assembly 102 of FIG. 8.

Referring to the embodiment as depicted in FIG. 18, two instances of the end portions (end sections) of the primary beam 802 are positioned on the respective first beam-locating features 104 of the prop head assembly 102 (or the first prop head assembly 202). One instance of the end section of the crossbeam 804 is positioned on a first beam-locating feature 104 of the prop head assembly 102 (or the first prop head assembly 202). It will be appreciated that the first beam-locating feature 104 as depicted in the embodiment of FIG. 18 is hidden from view. The primary beam 802 is positioned end-to-end, and the crossbeam 804 is orthogonally oriented to the primary beam 802. The end sections of the primary beam 802 and the crossbeam 804 are placed on the prop head assembly 102.

Figure 19:
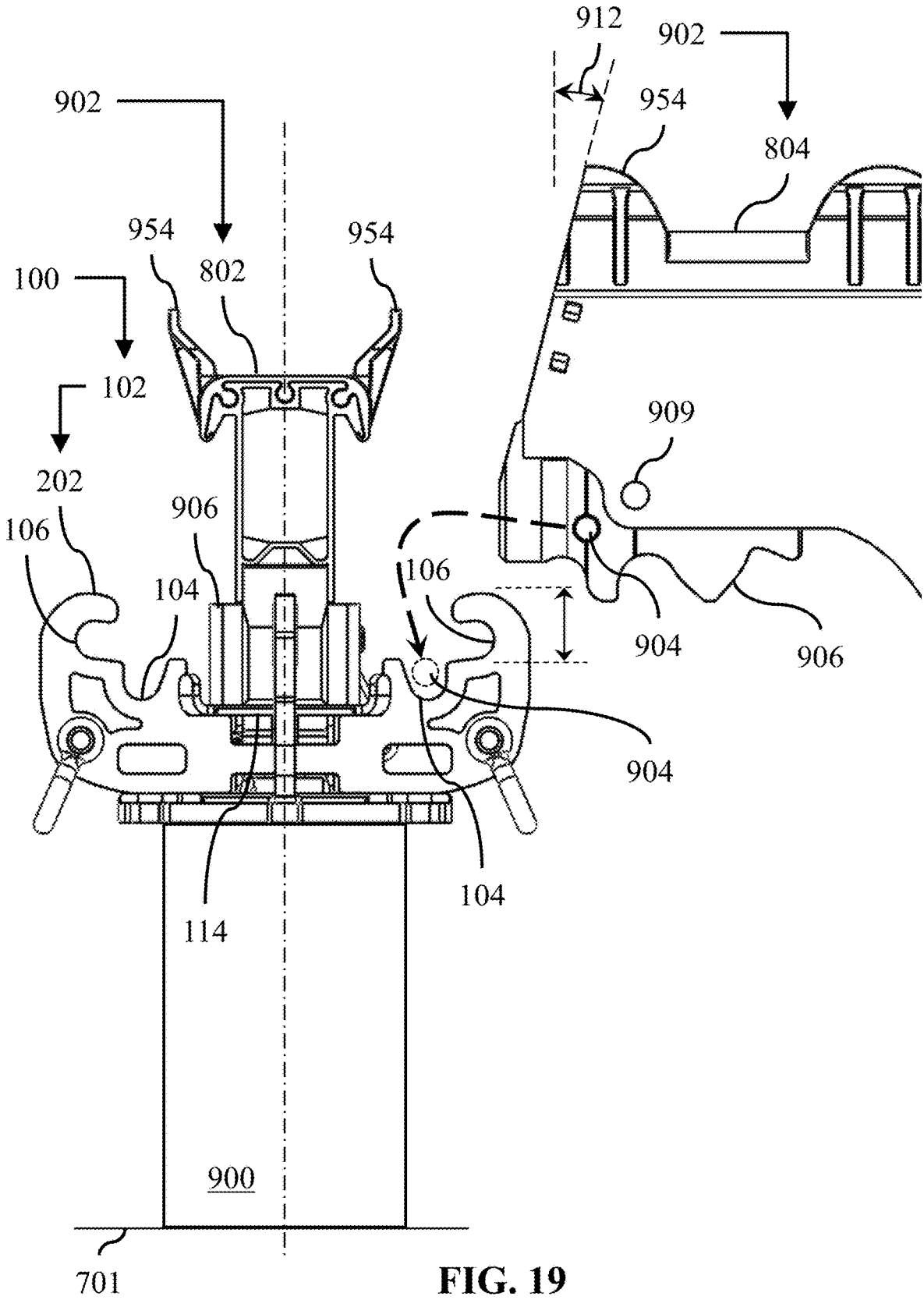

FIGS. 19-22 depict cross-sectional views of embodiments of the prop head assembly 102 of FIG. 19. The cross-sectional views of FIGS. 19-22 are taken along a cross-sectional line AA-AA of FIG. 18.

Referring to the embodiments of FIG. 19 to FIG. 22, the details are depicted regarding the crossbeam 804 (such as, the positions of the crossbeam 804, etc.). It will be appreciated that the description, which is associated with FIG. 19 to FIG. 22 and directed to the crossbeam 804, is equally applicable to the beam 902 and the primary beam 802.

Referring to the embodiment as depicted in FIG. 19, the crossbeam 804 is being moved toward the first beam-locating feature 104 of the prop head assembly 102, so that the crossbeam 804 may be selectively placed on the first beam-locating feature 104 of the prop head assembly 102.

Referring to the embodiment as depicted in FIG. 19, a lock receiver 909 is provided for beam lock assembly 907. The beam lock assembly 907 is not depicted in the embodiment of FIG. 19 (the lock receiver 909 is shown ready to receive the beam lock assembly 907).

Figure 20:
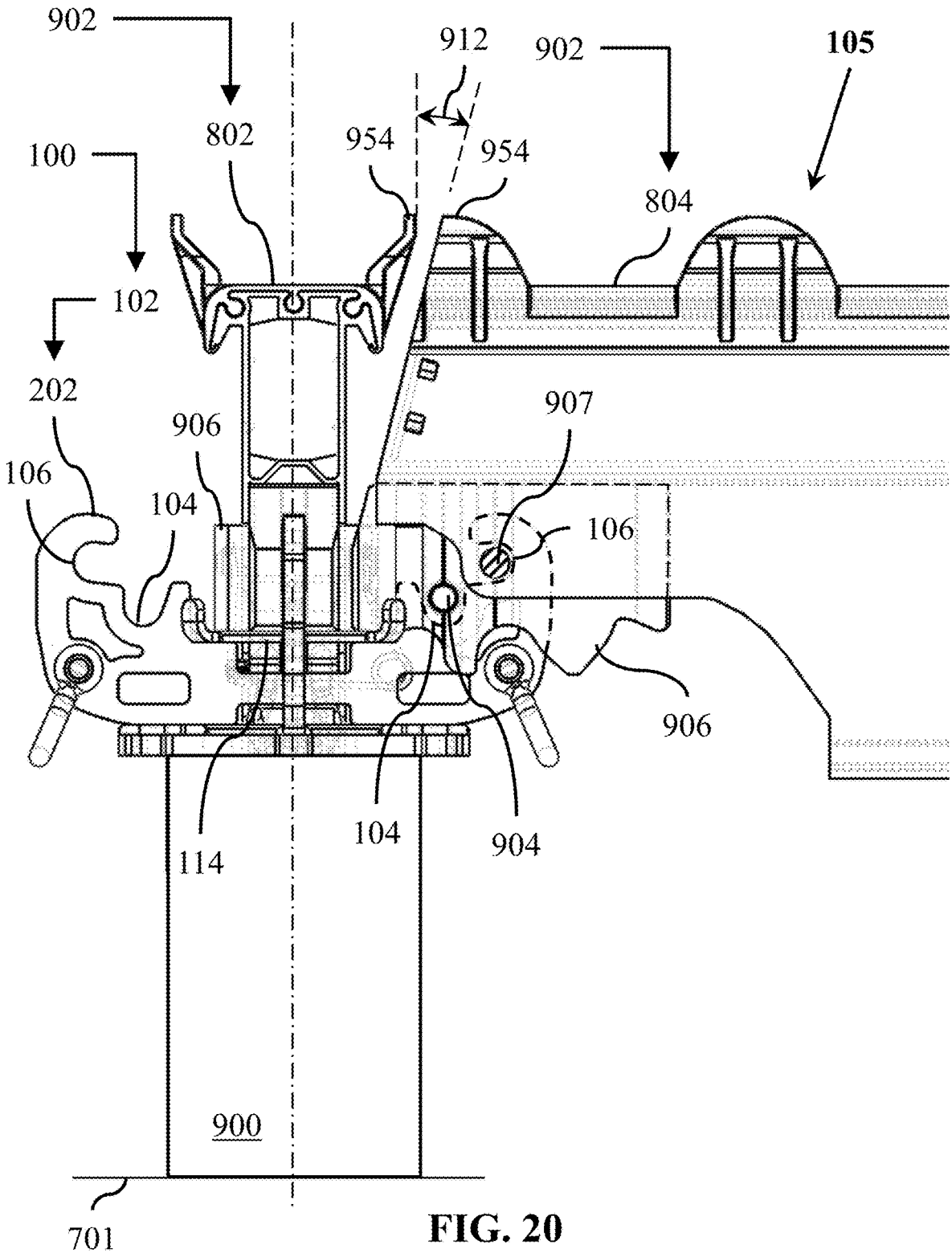

Referring to the embodiment as depicted in FIG. 20, there is depicted the first stationary position 105 of the crossbeam 804, in which the crossbeam 804 is received by (placed on) the first beam-locating feature 104 of the prop head assembly 102 (or the first prop head assembly 202). It will be appreciated that this case is equally applicable to the beam 902 and the primary beam 802, etc.

Referring to the embodiment as depicted in FIG. 20, the beam lock assembly 907 is received by the lock receiver 909 (depicted in the embodiment of FIG. 19) of the crossbeam 804 (or the primary beam 802 or beam 902, as the case may require).

Figure 21:
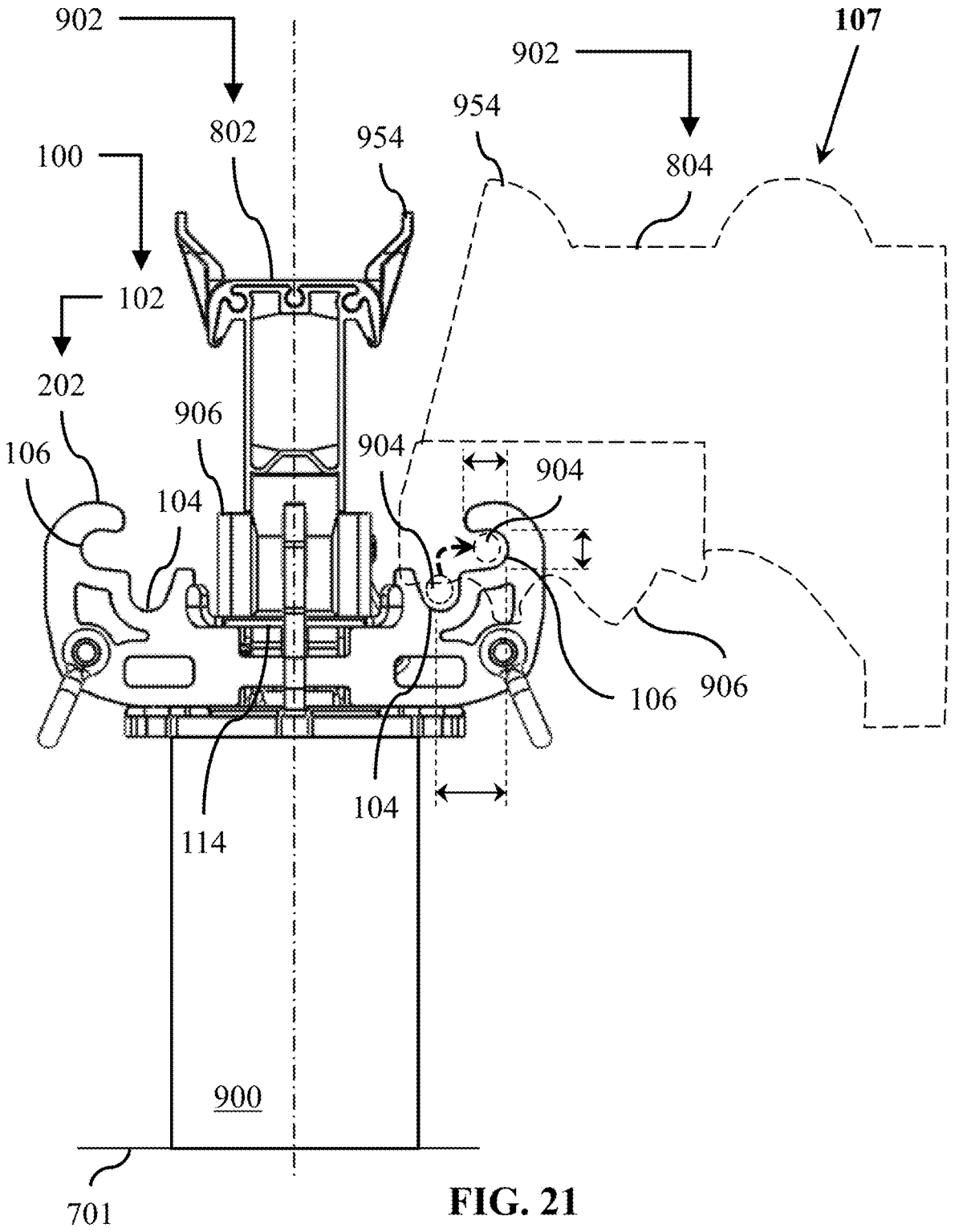

Referring to the embodiment as depicted in FIG. 21, there is depicted the second stationary position 107 of the crossbeam 804, in which the crossbeam 804 is received by (placed on) the second beam-locating feature 106 of the prop head assembly 102 (or the first prop head assembly 202). It will be appreciated that this case is equally applicable to the beam 902 and the primary beam 802.

Referring to the embodiment as depicted in FIG. 21, the beam lock assembly 907 is removed from the lock receiver 909 (depicted in the embodiment of FIG. 19) of the crossbeam 804 (or the primary beam 802 or beam 902, as the case may require), so that the crossbeam 804 may be permitted to move from the first beam-locating feature 104 to the second beam-locating feature 106 (as the case may require for an accidental movement or inadvertent movement of the crossbeam 804).

Figure 22:
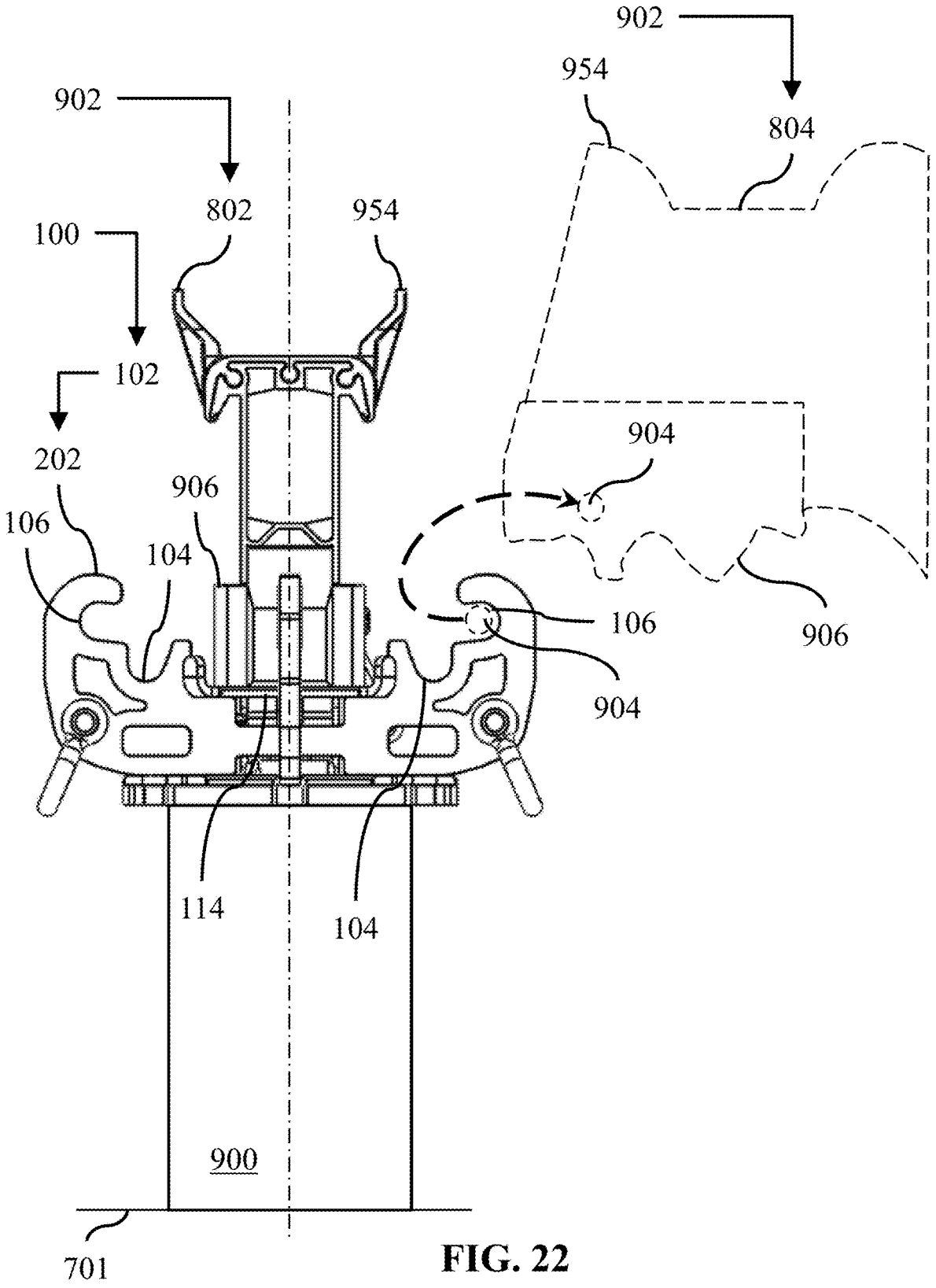

Referring to the embodiment as depicted in FIG. 22, the crossbeam 804 is removed away from the second beam-locating feature 106 of the prop head assembly 102 (or generally away from the prop head assembly 102).

Referring to the embodiment as depicted in FIG. 22, the beam lock assembly 907 is removed away from the lock receiver 909 (depicted in the embodiment of FIG. 19) of the crossbeam 804.

Referring to the embodiments as depicted in FIG. 19 to FIG. 22, the apparatus 100 is provided for the column 900. The apparatus 100 is also provided for the beam 902 (such as either for the primary beam 802 and/or the crossbeam 804). The beam 902 has the beam-reference portion 904. The apparatus 100 includes and is not limited to (comprises) a prop head assembly 102.

Referring to the embodiments as depicted in FIG. 19 to FIG. 22, the prop head assembly 102 is configured to be fixedly connected to the column 900. Preferably, the prop head assembly 102 is configured to be fixedly connectable to a top end section of the column 900. The prop head assembly 102 is also configured to support, at least in part, the beam 902 once the prop head assembly 102 is fixedly connected to the column 900. The prop head assembly 102 includes (and is not limited to) a synergistic combination of a first beam-locating feature 104 and a second beam-locating feature 106.

Referring to the embodiments as depicted in FIG. 19 to FIG. 22, the first beam-locating feature 104 may be called a first terminus-locating feature). As depicted, the first beam-locating feature 104 is configured to selectively receive, at least in part, the beam-reference portion 904 of the crossbeam 804. It will be appreciated that the first beam-locating feature 104 is configured to selectively receive, at least in part, the beam-reference portion 904 of any one of the beam 902, the primary beam 802 and/or the crossbeam 804 (as the case may be).

Referring to the embodiments as depicted in FIG. 19 to FIG. 22, the second beam-locating feature 106 may be called a second terminus-locating feature. The second beam-locating feature 106 is spaced apart from the first beam-locating feature 104. As depicted, the second beam-locating feature 106 is configured to selectively receive, at least in part, the beam-reference portion 904 of the crossbeam 804. It will be appreciated that the second beam-locating feature 106 is configured to selectively receive, at least in part, the beam-reference portion 904 of any one of beam 902, the primary beam 802 and/or the crossbeam 804 (as the case may be). The second beam-locating feature 106 is configured to receive the beam-reference portion 904 of the beam 902 once the beam-reference portion 904 of the beam 902 is inadvertently displaced (moved) away from the first beam-locating feature 104 and from the column 900 and toward the second beam-locating feature 106.

Referring to the embodiments as depicted in FIG. 19 to FIG. 22 (with a more specific detailed description), the apparatus 100 is provided for the column 900, and for the beam 902 having a beam-reference portion 904. The apparatus 100 includes and is not limited to (comprises) a prop head assembly 102. The prop head assembly 102 is configured to be fixedly connected to the column 900. Preferably, the prop head assembly 102 is configured to be fixedly connected to a top section (end section) of the column 900. The prop head assembly 102 is also configured to support, at least in part, the beam 902 once the prop head assembly 102 is fixedly connected to the column 900. The prop head assembly 102 includes (and is not limited to) a synergistic combination of a first beam-locating feature 104 and a second beam-locating feature 106.

Referring to the embodiments as depicted in FIG. 19 to FIG. 22, the first beam-locating feature 104 may be called a first terminus-locating feature. The first beam-locating feature 104 is configured to selectively receive the beam-reference portion 904 of the beam 902 (such as the crossbeam 804 as depicted and/or the primary beam 802). This is done in such a way that the first beam-locating feature 104, in use, locates (positions) the beam-reference portion 904 of the beam 902 at a first stationary position 105 (depicted in the embodiment of FIG. 20) relative to the column 900 (once the first beam-locating feature 104, in use, receives (at least in part) the beam-reference portion 904 of the beam 902 at the first stationary position 105.

Referring to the embodiments as depicted in FIG. 19 to FIG. 22, the second beam-locating feature 106 may be called a second terminus-locating feature. The second beam-locating feature 106 is spaced apart from the first beam-locating feature 104. The second beam-locating feature 106 is configured to selectively receive the beam-reference portion 904 of the beam 902 (such as the crossbeam 804 as depicted and/or the primary beam 802). This is done in such a way that the second beam-locating feature 106, in use, locates (positions) the beam-reference portion 904 of the beam 902 at a second stationary position 107 (as depicted in the embodiment of FIG. 21) relative to the column 900 (once the second beam-locating feature 106, in use, receives the beam-reference portion 904). The second beam-locating feature 106 is configured to receive the beam-reference portion 904 of the beam 902 once the beam-reference portion 904 of the beam 902 is inadvertently displaced (moved) away from the first beam-locating feature 104 and also displaced away from the column 900.

Referring to the embodiment as depicted in FIG. 20, the first beam-locating feature 104 is (preferably) configured to receive the beam-reference portion 904 of the beam 902 once the beam 902 is positioned, in use, at the first beam-locating feature 104. The first beam-locating feature 104 is (preferably) further configured to limit inadvertent side-to-side horizontal movement and limit inadvertent downward vertical movement of the beam-reference portion 904 of the beam 902 once the beam-reference portion 904 is positioned at the first beam-locating feature 104. The first beam-locating feature 104 is (preferably) further configured to permit unimpeded upward vertical movement of the beam-reference portion 904 of the beam 902 once the beam-reference portion 904 is positioned at the first beam-locating feature 104.

Referring to the embodiment as depicted in FIG. 20, the first beam-locating feature 104 is (preferably) further configured to support the beam-reference portion 904 of the beam 902 once the beam-reference portion 904, in use, is received by the first beam-locating feature 104.

Referring to the embodiment as depicted in FIG. 21, the second beam-locating feature 106 is (preferably) further configured to receive the beam-reference portion 904 of the beam 902 once the beam-reference portion 904 is positioned, in use, at the second beam-locating feature 106. The second beam-locating feature 106 is (preferably) further configured to limit inadvertent upward vertical movement and limit inadvertent downward vertical movement of the beam-reference portion 904 of the beam 902 once the beam-reference portion 904 is positioned at the second beam-locating feature 106. The second beam-locating feature 106 is (preferably) further configured to limit inadvertent horizontal movement of the beam-reference portion 904 of the beam 902 away from the column 900 once the beam-reference portion 904 is positioned at the second beam-locating feature 106. The second beam-locating feature 106 is (preferably) further configured to permit unimpeded horizontal movement of the beam-reference portion 904 of the beam 902 toward the column 900 once the beam-reference portion 904 is positioned at the second beam-locating feature 106.

Referring to the embodiment as depicted in FIG. 21, the second beam-locating feature 106 is (preferably) configured to support the beam-reference portion 904 of the beam 902 once the beam-reference portion 904, in use, is received by the second beam-locating feature 106.

Figure 23:
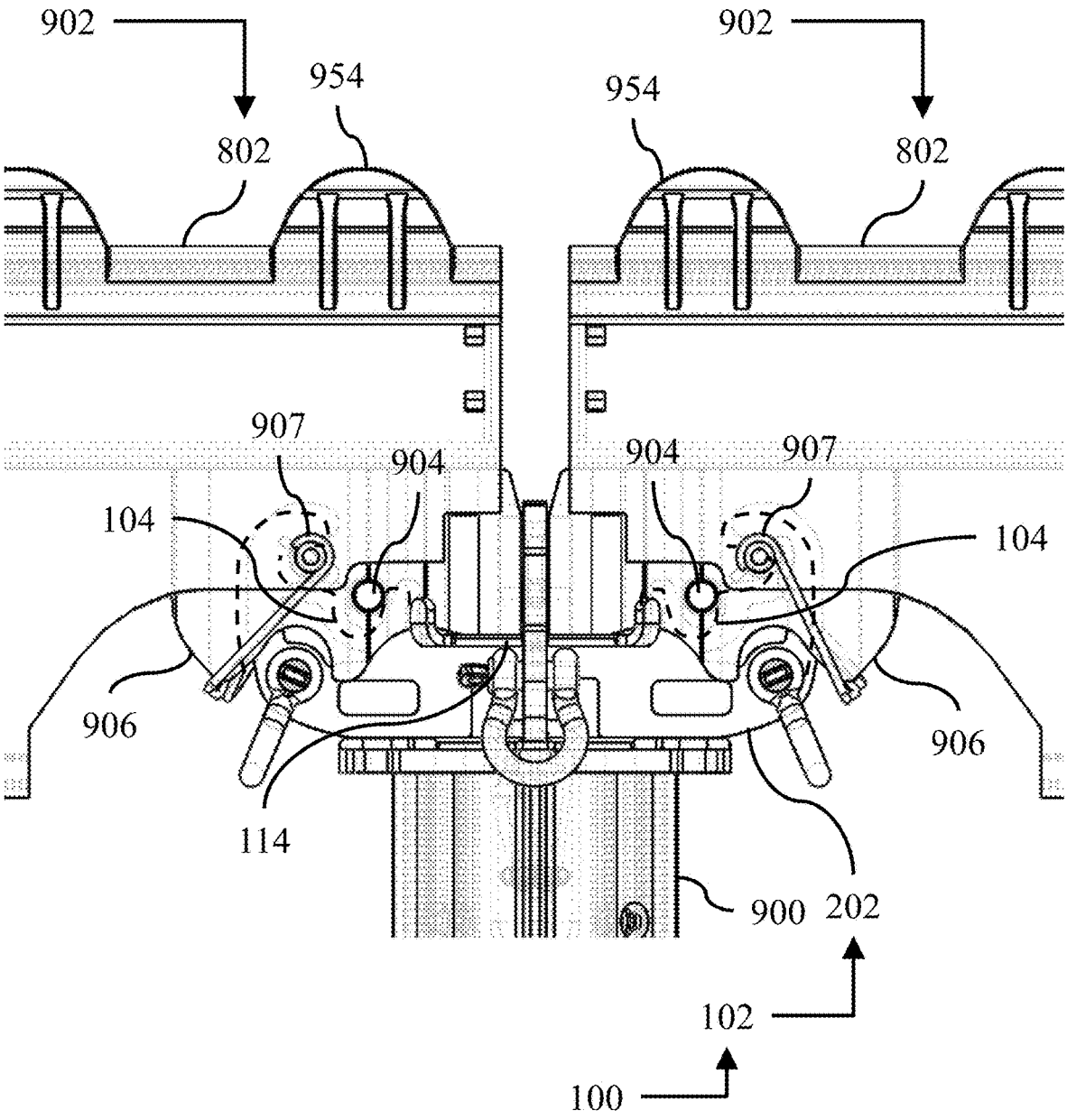

FIG. 23 depicts a cross-sectional view of an embodiment of the prop head assembly 102 of FIG. 19. The cross-sectional view of FIG. 23 is taken along a cross-sectional line BB-BB of FIG. 18.

Referring to the embodiment as depicted in FIG. 23, the end portions of the primary beam 802 are placed in an end-to-end relationship once the two instances (as depicted) of the primary beam 802 are positioned on the prop head assembly 102.

Figure 24:
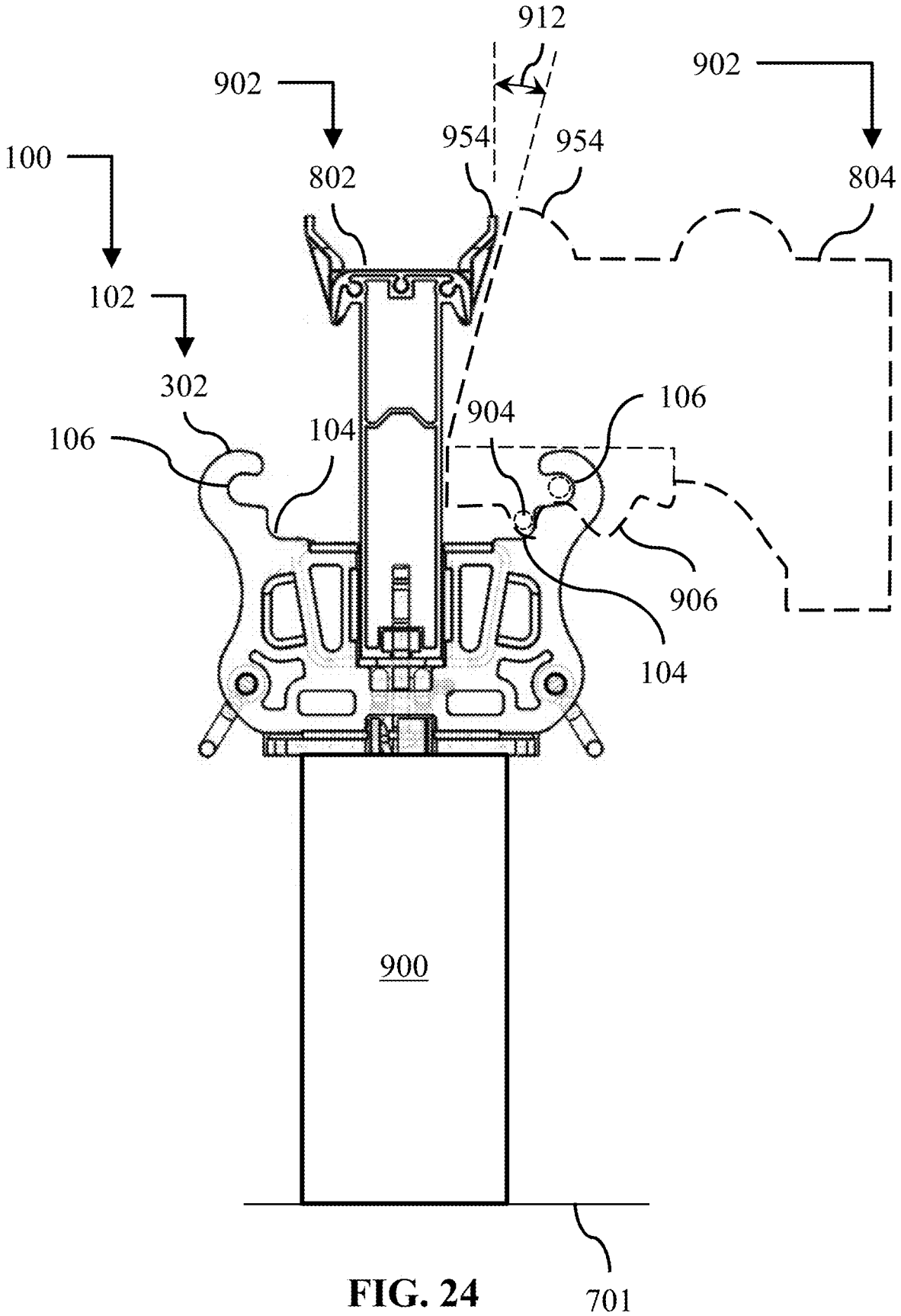

FIG. 24 depicts a side view of an embodiment of the prop head assembly 102 of FIG. 9.

Figure 1:
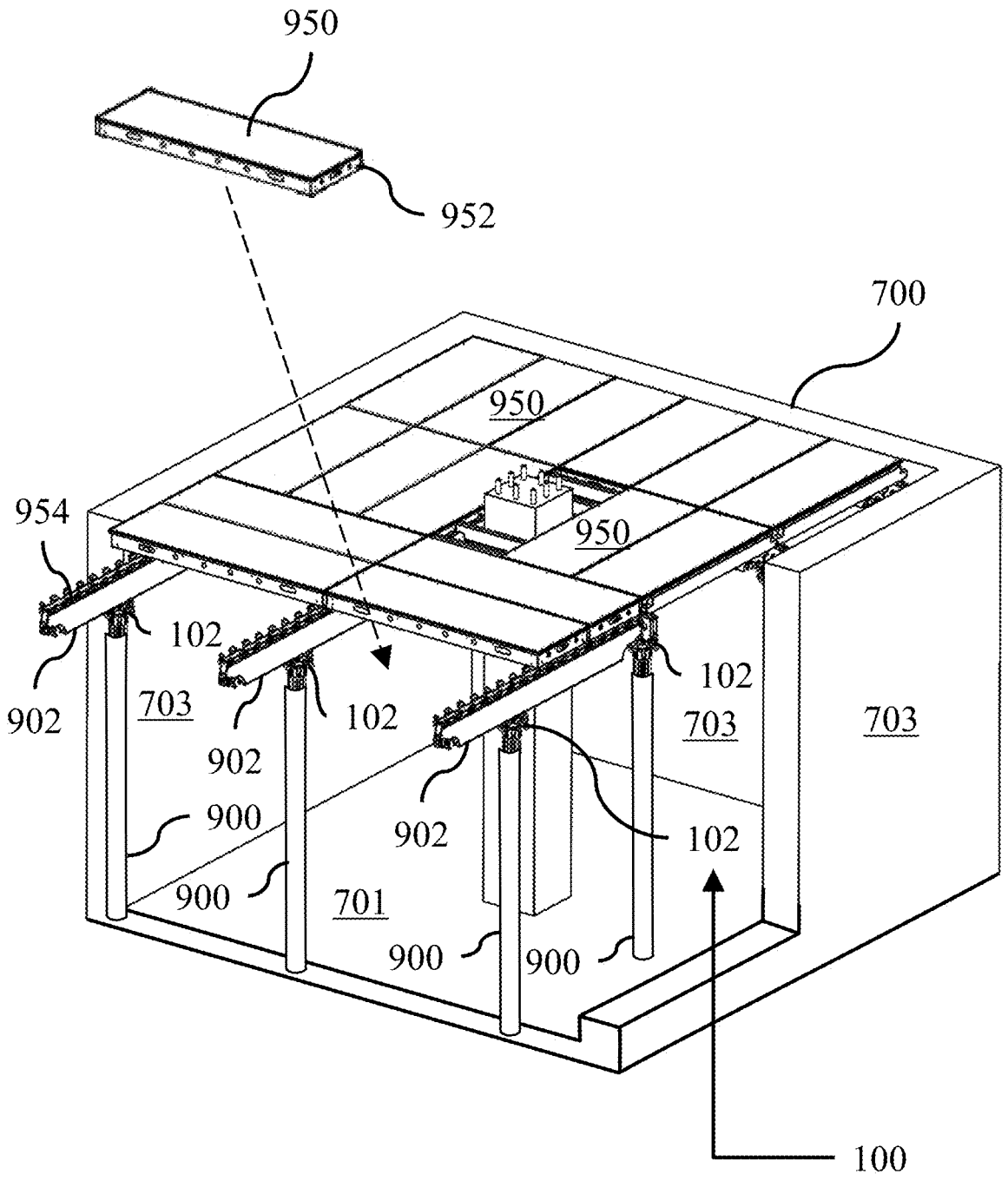
Figure 2:
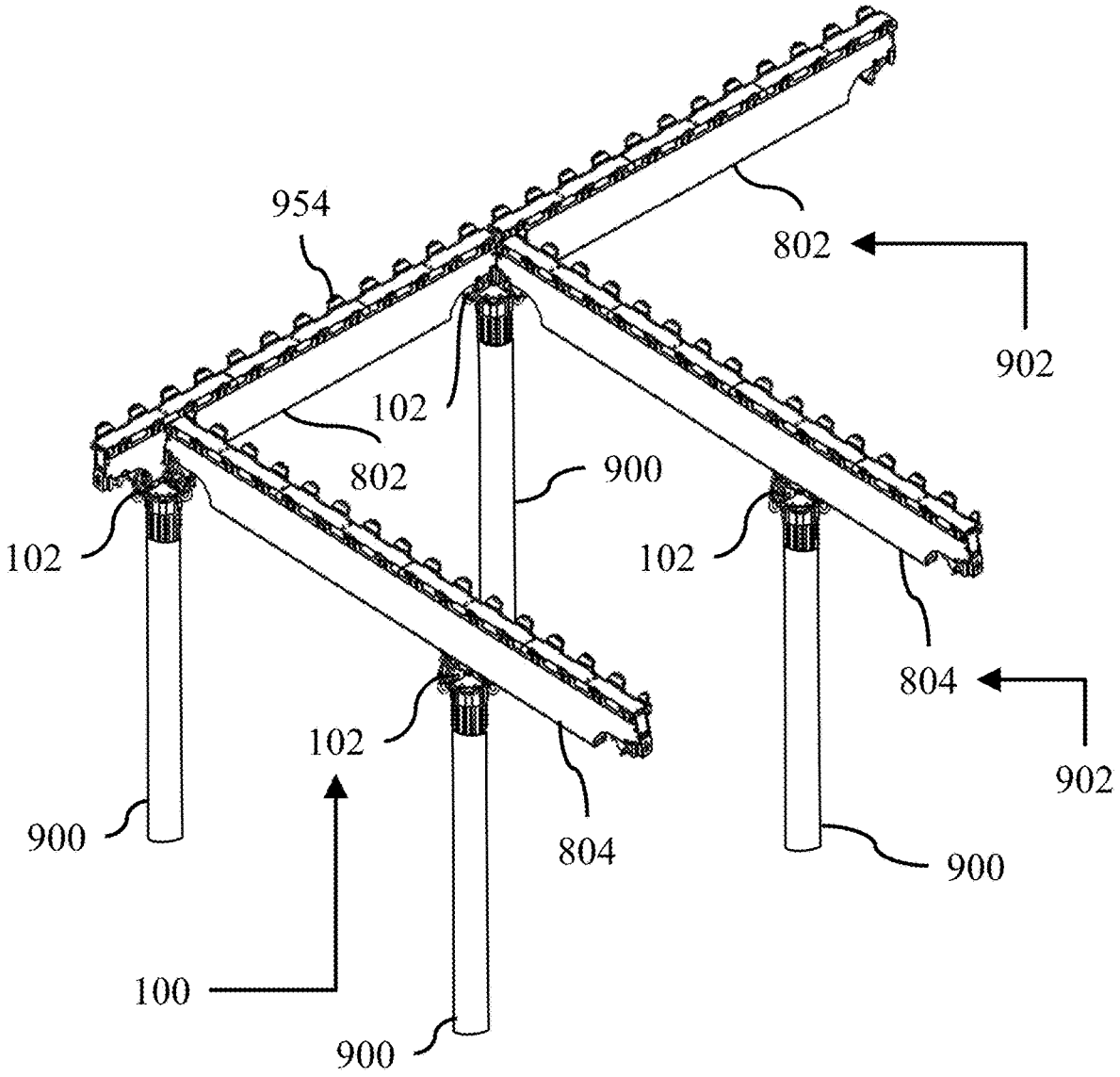
Figure 3:
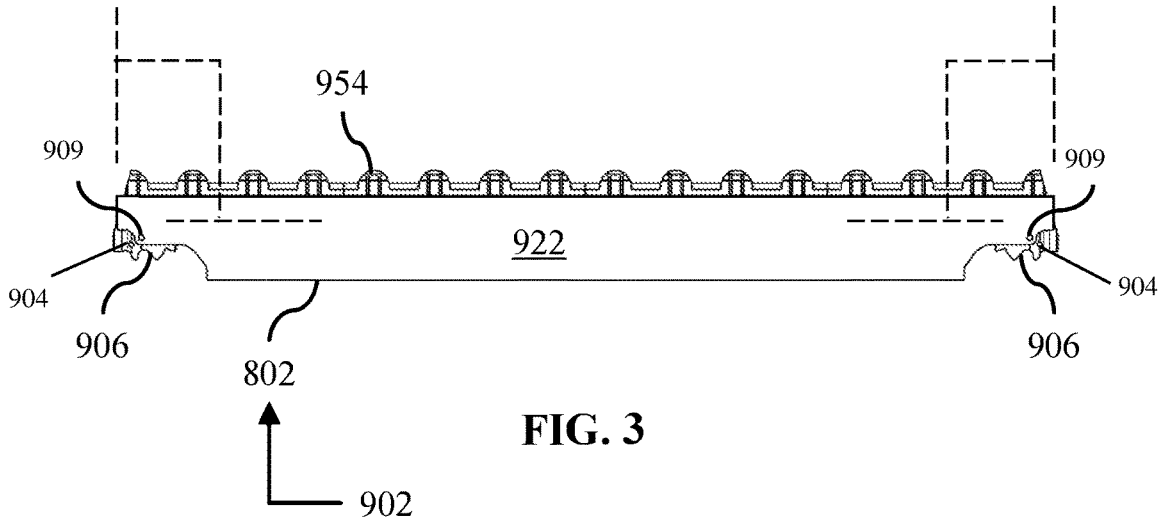
Figure 4:
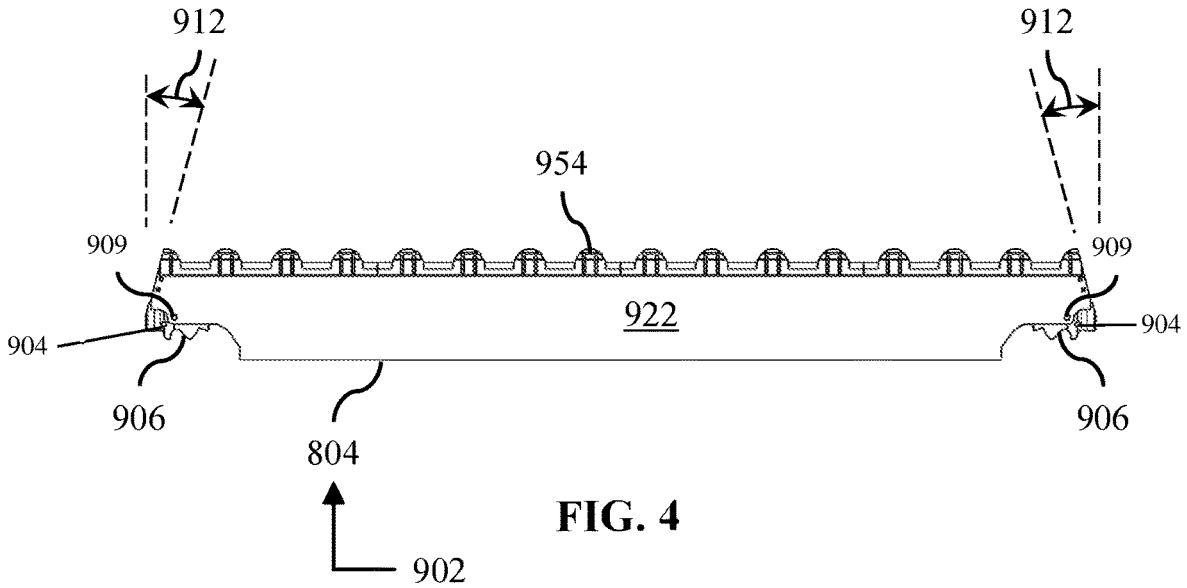
Figure 5:
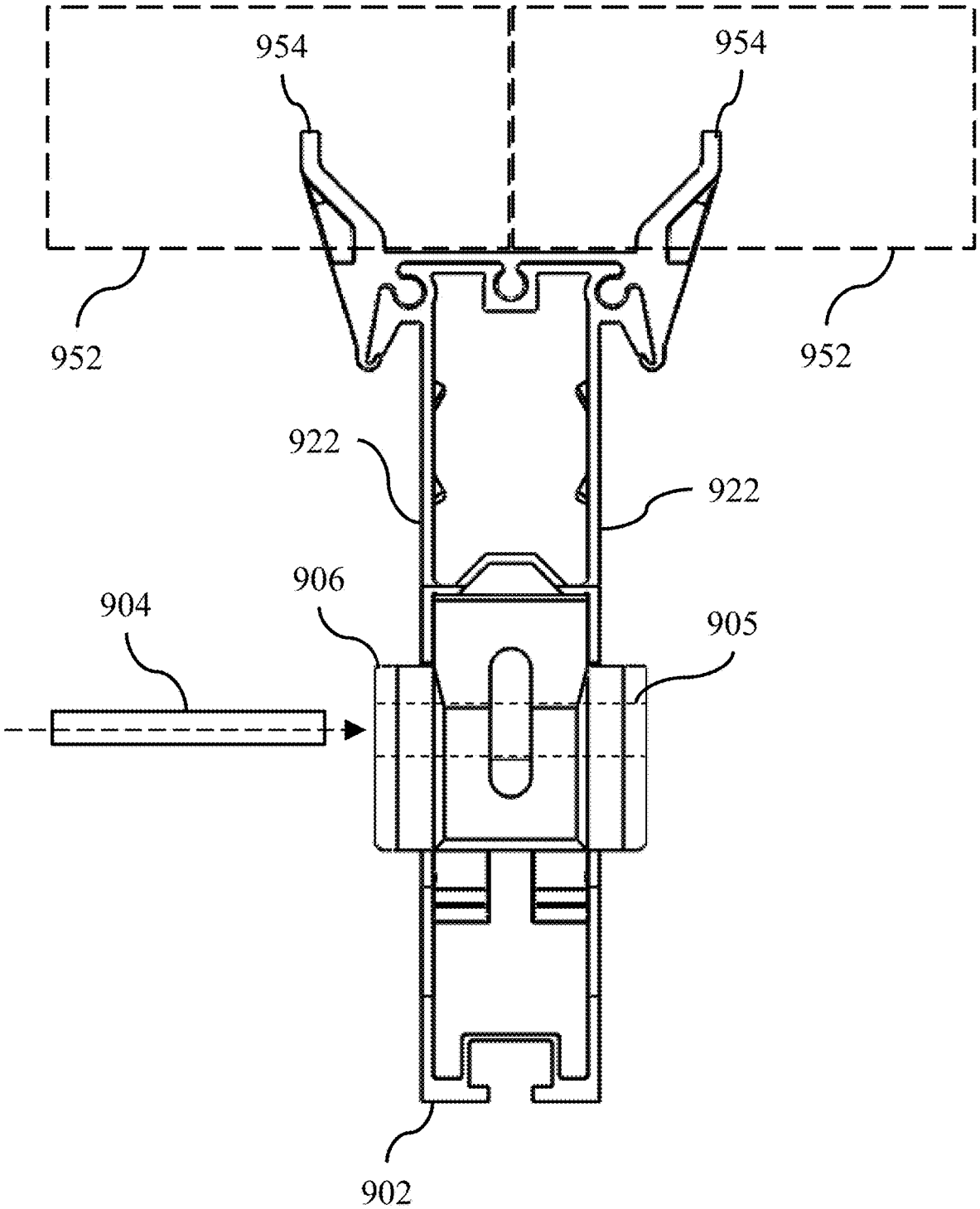
Figure 6:
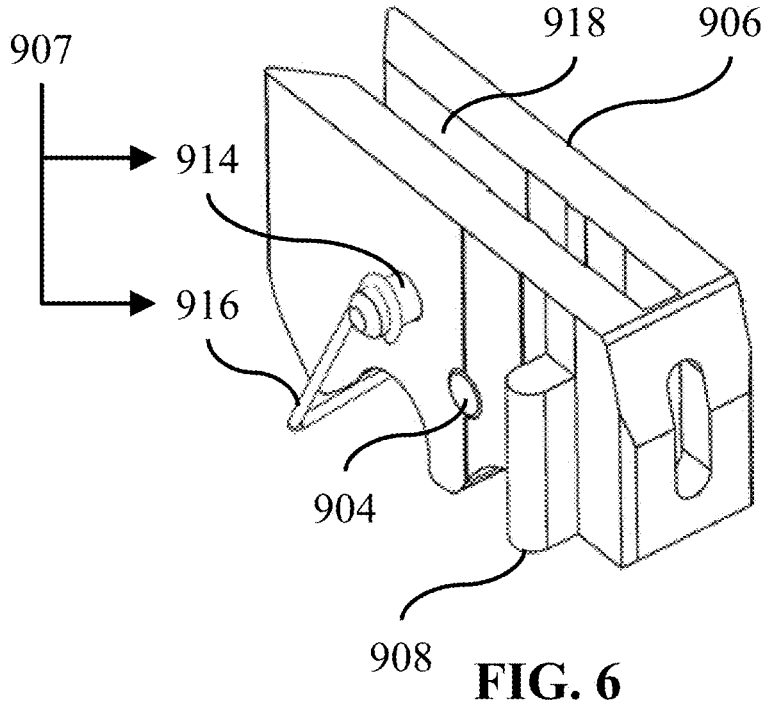
Figure 7:
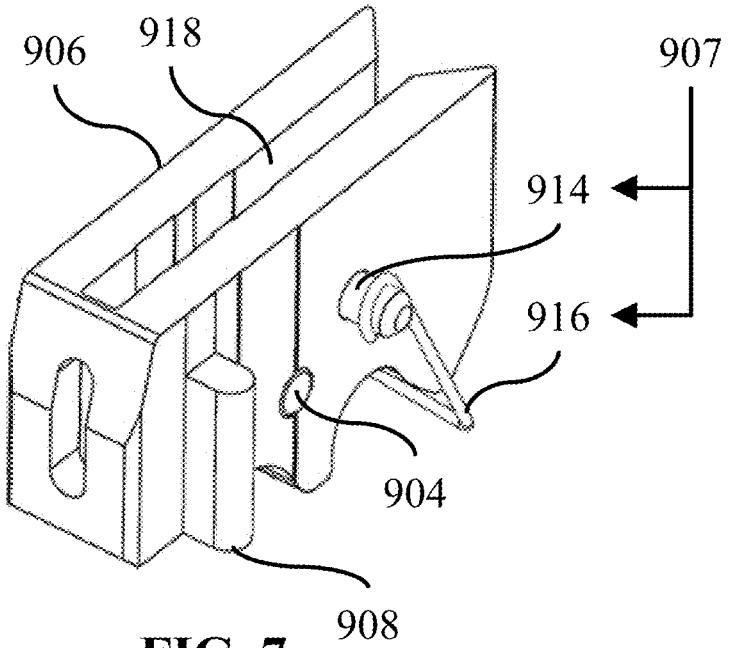

Referring to the embodiment as depicted in FIG. 24, a third deployment scenario is depicted, and includes the case where the prop head assembly 102 is positioned underneath (and supports) a junction zone (a matrix junction as depicted in the embodiments of FIG. 1 and/or FIG. 2), in which the junction zone is positioned below (and supports) the end portion of the crossbeam 804, and the end portion of the crossbeam 804 is positioned to face a sidewall of the primary beam 802. Preferably, the end portion of the crossbeam 804 is positioned adjacent to the sidewall of the primary beam 802 in a close relationship or a proximate relationship.

Figure 25:
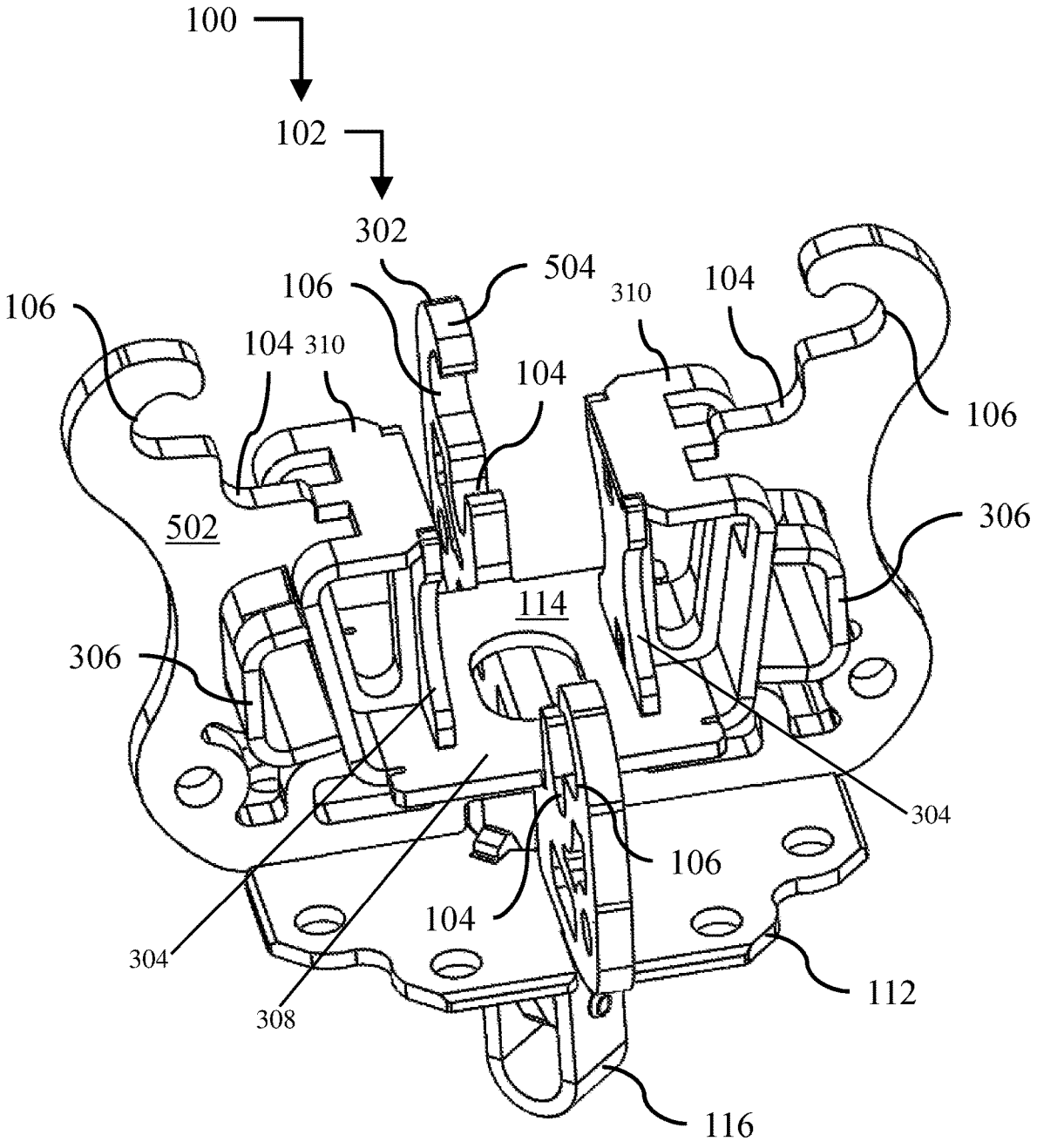

FIG. 25 depicts a perspective view of an embodiment of the prop head assembly 102 of FIG. 9.

Figure 26:
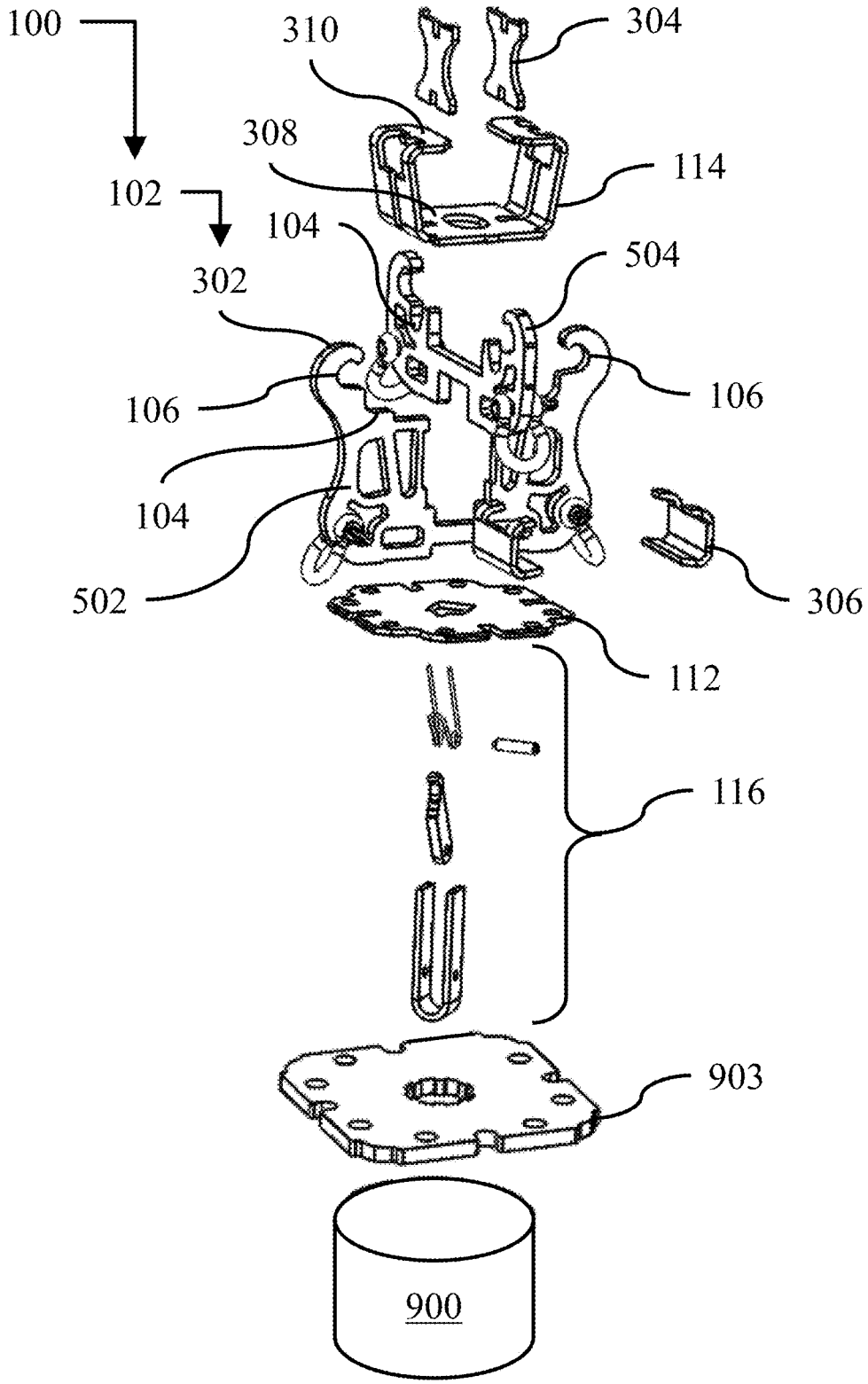

FIG. 26 depicts an exploded perspective view of an embodiment of the prop head assembly 102 of FIG. 9.

Referring to the embodiments as depicted in FIG. 25 and FIG. 26, the second prop head assembly 302 includes a first support element 304 and a second support element 306. The first support element 304 is configured to reinforce the shape and configuration of the load-receiving feature 114. The second support element 306 is configured to reinforce the shape and configuration of the first locator plate assembly 502. The first beam-locating feature 104 and the second beam-locating feature 106 of the first locator plate assembly 502 are spatially positioned higher than the first beam-locating feature 104 and the second beam-locating feature 106 of the second locator plate assembly 504. The prop head assembly 102 includes a first locator plate assembly 502, and a second locator plate assembly 504. The first beam-locating feature 104 and the second beam-locating feature 106 provided by the first locator plate assembly 502 are positioned higher than the first beam-locating feature 104 and the second beam-locating feature 106 provided by the second locator plate assembly 504.

Figure 29:
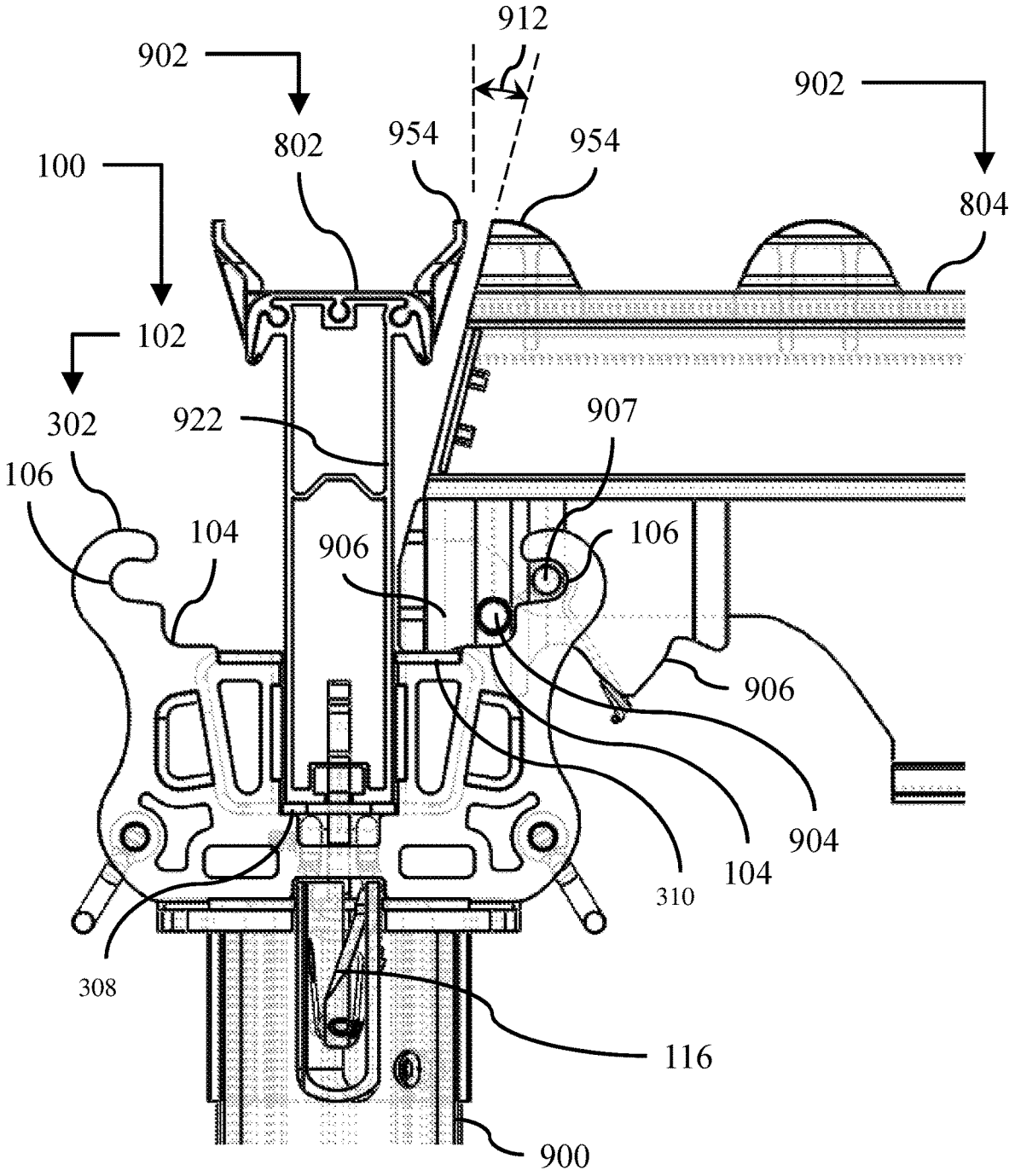
Figure 30:
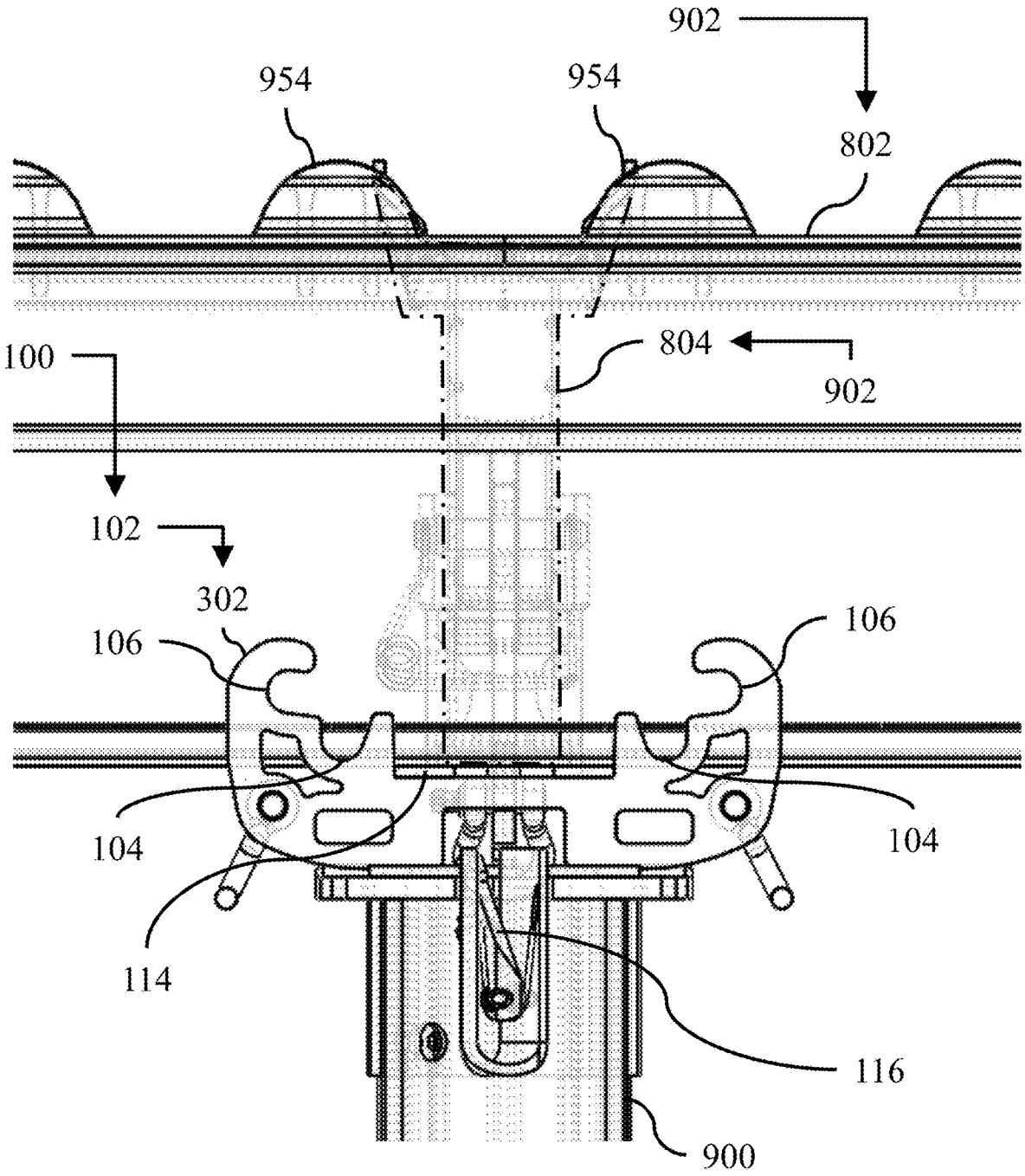

Referring to the embodiment as depicted in FIG. 25 and FIG. 26, the load-receiving feature 114 includes a lower portion 308 and an upper portion 310. Reference is made to FIG. 29 and FIG. 30 for the manner in which the load-receiving feature 114, in use, interacts with the crossbeam 804 and the primary beam 802.

Figure 27:
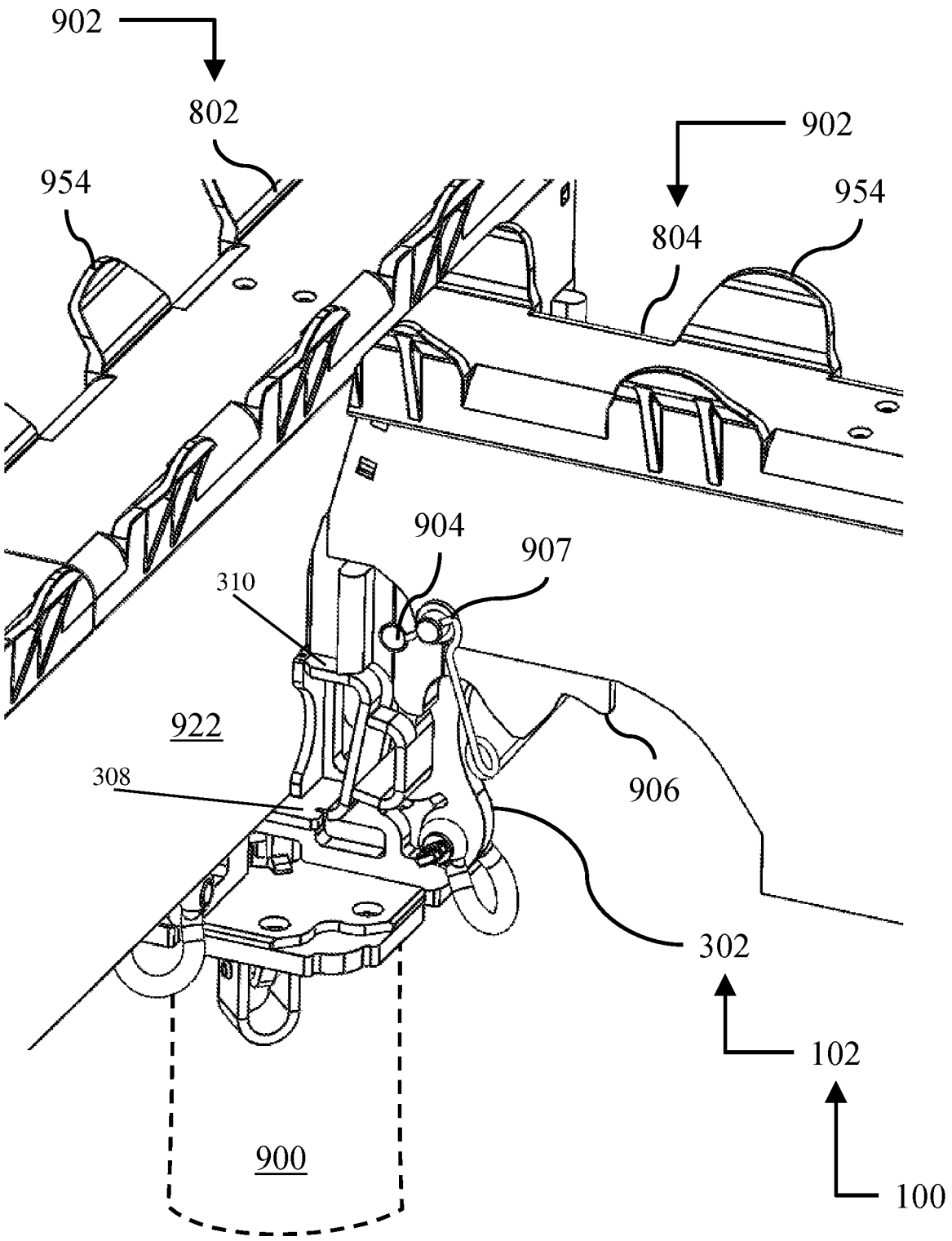
Figure 28:
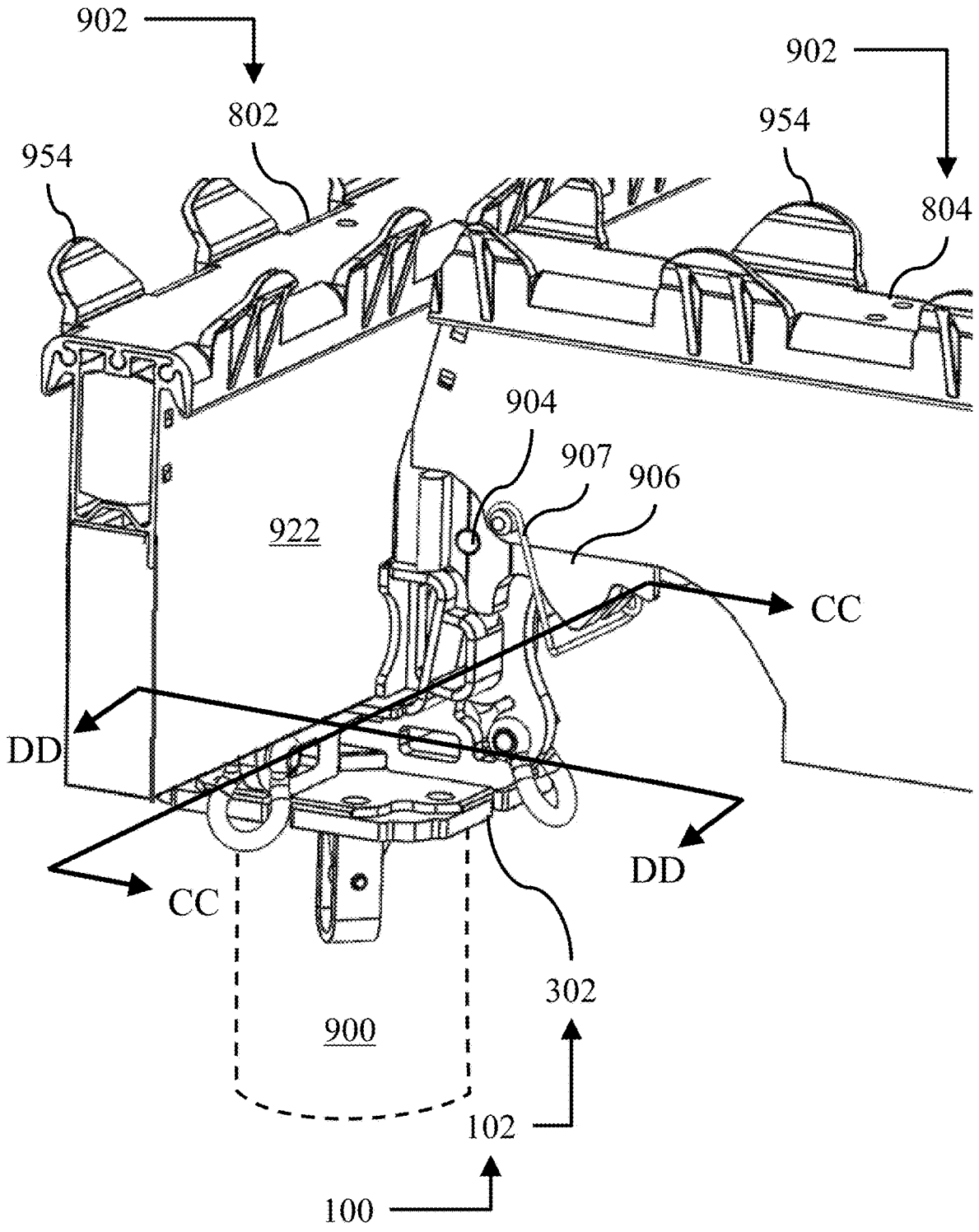

FIG. 27 and FIG. 28 depict perspective views of embodiments of the prop head assembly 102 of FIG. 25.

Referring to the embodiments as depicted in FIG. 27 and FIG. 28, the primary beam 802 (the bottom section of the primary beam 802) is positioned on the second prop head assembly 302, between the end portions of the primary beam 802. The sidewall 922 of the primary beam 802 is positioned proximate to the crossbeam 804 once the crossbeam 804 is positioned and located on the second prop head assembly 302. The crossbeam 804 is orthogonally oriented relative to the sidewall 922 of the primary beam 802.

Referring to the embodiments as depicted in FIG. 27 and FIG. 28, a third deployment scenario is depicted, and includes the case where the prop head assembly 102 is positioned underneath (and supports) a junction zone (a matrix junction), in which the junction zone is positioned below (and supports) the end portion of the crossbeam 804, and the end portion of the crossbeam 804 is positioned to face a sidewall of the primary beam 802. Preferably, the end portion of the crossbeam 804 is positioned adjacent to the sidewall of the primary beam 802 in a close relationship or a proximate relationship.

FIG. 29 depicts a cross-sectional view of an embodiment of the prop head assembly 102 of FIG. 28. The cross-sectional view of FIG. 29 is taken along a cross-sectional line DD-DD of FIG. 28.

Referring to the embodiment as depicted in FIG. 29, the beam lock assembly 907 is installed to the second beam-locating feature 106 of the crossbeam 804 so that the beam lock assembly 907, in use, locks the crossbeam 804 to the second prop head assembly 302. The beam-reference portion 904 of the crossbeam 804 is received by or positioned on the first beam-locating feature 104 of the second prop head assembly 302.

Referring to the embodiment as depicted in FIG. 29, the lower section of the primary beam 802 is received by the lower portion of the load-receiving feature 114 of the second prop head assembly 302. The lower portion of the load-receiving feature 114, in use, supports the primary beam 802 (once the primary beam 802 is received by the lower portion of the load-receiving feature 114).

Referring to the embodiment as depicted in FIG. 29, the distal end portion of the beam end support 906 (which is received and held by the crossbeam 804) is received (at least in part) by the upper portion of the load-receiving feature 114 of the second prop head assembly 302. The upper portion of the load-receiving feature 114 of the second prop head assembly 302, in use, supports (the weight of) the crossbeam 804 (once the crossbeam 804 is received by the upper portion of the load-receiving feature 114).

FIG. 30 depicts a cross-sectional view of an embodiment of the prop head assembly 102 of FIG. 28. The cross-sectional view of FIG. 30 is taken along a cross-sectional line CC-CC of FIG. 28.

Referring to the embodiment as depicted in FIG. 30, the lower section of the primary beam 802 is received by the lower portion of the load-receiving feature 114 of the second prop head assembly 302. The lower portion of the load-receiving feature 114, in use, supports the primary beam 802 (once the primary beam 802 is received by the lower portion of the load-receiving feature 114).

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus 100 (either explicitly or inherently). The apparatus 100 may include any suitable combination and/or permutation of the technical features as identified in the detailed description, as may be required and/or desired to suit a particular technical purpose and/or technical function. It will be appreciated that, where possible and suitable, any one or more of the technical features of the apparatus 100 may be combined with any other one or more of the technical features of the apparatus 100 (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus 100 to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a structure, including:

a vertically-extending construction column configured to be positionable on a working surface in such a way that the vertically-extending construction column, in use, extends vertically above the working surface once the vertically-extending construction column, in use, is positioned on the working surface; and a horizontal construction beam assembly having a beam-reference portion; and a prop head assembly configured to be fixedly connected to the vertically-extending construction column, the prop head assembly also configured to support, at least in part, the horizontal construction beam assembly once the prop head assembly is fixedly connected to the vertically-extending construction column, the prop head assembly includes:

a first beam-locating feature configured to selectively receive the beam-reference portion of the horizontal construction beam assembly in such a way that the first beam-locating feature, in use, locates the beam-reference portion of the horizontal construction beam assembly at a first stationary position relative to the vertically-extending construction column once the first beam-locating feature, in use, selectively receives the beam-reference portion;

a second beam-locating feature spaced apart from the first beam-locating feature;

a first locator plate assembly having the first and second beam-locating features; and a second locator plate assembly having a first beam-locating feature and a second beam-locating feature, wherein the first and second beam-locating features of the first locator plate assembly are positioned higher than the first and second beam-locating features of the second locator plate assembly.

2. The apparatus of claim 1, wherein the prop head assembly is configured to be positionable underneath and to support:

a bottom section of the horizontal construction beam assembly at a position located midway between end sections of the horizontal construction beam assembly; and an end portion of a crossbeam while an end portion of the crossbeam is positioned to face a sidewall of the horizontal construction beam assembly, and the end portion of the crossbeam is positioned adjacently to the sidewall of the horizontal construction beam assembly in a close relationship.

3. The apparatus of claim 2, wherein the crossbeam is orthogonally oriented relative to the sidewall of the horizontal construction beam assembly.

* * * * *